United States Patent [19]

Minagawa et al.

[11] 4,141,730

[45] Feb. 27, 1979

[54] MULTILAYER COLOR PHOTOGRAPHIC MATERIALS

[75] Inventors: Yoshisato Minagawa; Naoki Arai; Takehiko Ueda, all of Minami-ashigara, Japan

[73] Assignee: Fuji Photo Film Co., Ltd., Minami-ashigara, Japan

[21] Appl. No.: 674,460

[22] Filed: Apr. 7, 1976

[30] Foreign Application Priority Data

Apr. 8, 1975 [JP] Japan ..... 50-42541
May 19, 1975 [JP] Japan ..... 50-59478

[51] Int. Cl.[2] ..... G03C 7/04; G03C 1/76

[52] U.S. Cl. ..... 96/9; 96/73; 96/74

[58] Field of Search ..... 96/74, 3, 9, 73

[56] References Cited

U.S. PATENT DOCUMENTS

| | | | |
|---|---|---|---|
| 3,087,817 | 4/1963 | Rogers | 96/3 |
| 3,227,550 | 1/1966 | Whitmore et al. | 96/3 |
| 3,227,551 | 1/1966 | Barr et al. | 96/3 |
| 3,227,552 | 1/1966 | Whitmore | 96/3 |
| 3,243,294 | 3/1966 | Barr | 96/3 |
| 3,312,549 | 4/1967 | Salminen | 96/3 |
| 3,352,672 | 11/1967 | Hoppe | 96/3 |
| 3,352,679 | 11/1967 | Salminen | 96/3 |
| 3,364,022 | 1/1968 | Barr | 96/3 |
| 3,615,602 | 10/1971 | Credner | 96/74 |
| 3,630,731 | 12/1971 | Schwan | 96/3 |
| 3,653,896 | 4/1972 | Stewart et al. | 96/3 |
| 3,779,756 | 12/1973 | Farran | 96/74 |
| 3,844,795 | 10/1974 | Puschel | 96/9 |
| 3,996,055 | 12/1976 | Minagawa et al. | 96/9 |
| 4,004,929 | 1/1977 | Orvis | 96/9 |
| 4,029,503 | 6/1977 | Fujiuhara et al. | 96/9 |
| 4,046,573 | 9/1977 | Inouye et al. | 96/9 |

FOREIGN PATENT DOCUMENTS

| | | | |
|---|---|---|---|
| 503752 | 4/1939 | United Kingdom | 96/22 |

*Primary Examiner*—Mary F. Kelley

*Attorney, Agent, or Firm*—Sughrue, Rothwell, Mion, Zinn and Macpeak

[57] ABSTRACT

In a multilayer color photographic material essentially comprising a support having coated thereon, in succession, a red-sensitive silver halide emulsion layer and a green-sensitive silver halide emulsion layer, with an optional yellow filter layer and a blue-sensitive silver halide emulsion layer, by disposing a non-sensitive auxiliary layer containing a non-diffusible colored coupling compound which releases a diffusible dye at color development capable of being removed from the photographic layer at development, an effective masking can be applied to the side absorption of cyan dye image without reducing the sensitivity of the red-sensitive silver halide emulsion layer during storage before or after exposure.

The red-sensitive silver halide emulsion layer may optionally be composed of two or more layers having different sensitivities, whereby the non-diffusible colored coupling compound can be incorporated into at least one layer selected from the non-sensitive auxiliary layer and a red-sensitive silver halide emulsion layer having high sensitivity.

The non-diffusible colored coupling compound can be present in the following locations:

(1) in a non-photosensitive layer which contains no photosensitive silver halide grains disposed under a red-sensitive emulsion layer and in contact therewith on a support;

(2) in the most sensitive layer of two or more red-sensitive emulsion layers having different sensitivities;

(3) in a non-photosensitive layer containing no light-sensitive silver halide grains disposed between a red-sensitive emulsion layer and a green-sensitive emulsion layer.

In addition to being present in any one of (1), (2) and (3) above, the colored coupling compound can also be present in the layers of (1) plus (2), (1) plus (3), (2) plus (3) or (1) plus (2) plus (3).

20 Claims, 6 Drawing Figures

MULTILAYER COLOR PHOTOGRAPHIC MATERIALS

BACKGROUND OF THE INVENTION

1. Field of the Invention

The present invention relates to multilayer color photographic materials, particularly, to multilayer color photographic materials which provide color print images having excellent color reproducibility, show less change in photographic properties during storage, and show less image changes during storage after exposure and development. More particularly, it relates to multilayer negative color photographic materials.

2. Description of the Prior Art

It is well known that when a silver halide color photographic material is subjected to color development, color forming couplers undergo a coupling reaction with the oxidation product of a primary aromatic amino color developing agent to form images of dyes such as indophenols, indamines, azomethines, phenoxazines, phenazines, etc. In a color photographic system, a color reporoduction method using a subtractive color process is usually used to form cyan, magenta, and yellow dye images which have a complementary color relationship to the primary colors red, green, and blue, respectively. Ordinarily, a phenolic coupler (i.e., a phenol or a naphthol) is used for forming a cyan dye image, a pyrazolone or cyanoacetyl coupler is used for forming a magenta dye image, and an acylacetamide or benzoylmethane coupler is used for forming a yellow dye image.

The dye images thus formed do not have a theoretically ideal absorption spectra. For instance, cyan dye images are theoretically required to absorb red light only, but they generally have side absorption in the green and blue regions. The presence of such a side absorption is undesirable in the color reproduction of color photographic materials. To overcome this defect, a masking technique, i.e., using colored dye forming couplers or colored couplers, is used in this art (see, e.g., U.S. Pat. No. 2,428,054). A color print obtained from a color photographic material to which such a masking technique has been applied is superior in color reproducibility.

According to the masking technique teaching described in U.S. Pat. No. 2,428,054, it is said to be desirable, to correct the above indicated side absorption of the cyan dye, to use a colored cyan dye forming coupler which is colored so that it has an absorption in the blue and/or green region and a colorless cyan dye forming coupler together as cyan dye forming couplers (hereinafter, referred to simply as a cyan coupler in this specification). This is based on the masking principle where the increase of the side absorption of the cyan dye occurring at color development is compensated for by causing the color of the colored cyan coupler to disappear by reaction of the colored cyan coupler and the oxidation product of a primary aromatic amino color developing agent (i.e., a coupling reaction of the colored cyan coupler); thus, even if a cyan dye is formed, the increase of the optical density in the side abosrption region disappears at printing. However, the masking effect using conventional colored couplers is insufficient.

A latent image, that is, a collection of fine photodecomposed silver atoms formed in silver halide grains by exposure of the silver halide grains, is apt to be readily oxidized during storage of the photographic material before development to cause a regression of the latent image. It is becoming clear that regression of latent images depends on the oxidation-reduction properties of a coated photosensitive layer based on the composition of the photosensitive emulsion, and that certain couplers have an influence on the regression of the latent image by the oxidation-reduction property of the system.

On the other hand, the oxidation-reduction property of a coupler also has an influence on the photographic properties of a color photographic film containing the coupler during storage thereof before exposure, and changes the photographic properties. This is believed to be due to the photosensitive center of the silver halide grains, that is, a photosensitive core or a sensitive center formed on the surface of a silver halide grain by chemical sensitization is composed of a collection of fine atoms or molecules, and the photosensitive center changes with changes in the oxidation-reduction property of the total photosensitive emulsion during storage of the photographic material.

Furthermore, dye type colored couplers for masking, that is, colored couplers wherein a dye group in the molecule is connected to the coupling position by a coupling radical as described in, e.g., Offenlegungsshrift No. 2,424,946; U.S. Pat. No. 3,476,563; Japanese Patent Application No. 98,469/1974; and Research Disclosure (No. 12313); July, 10–11 (1974), have the merit that they can be selected according to the use of the color photographic material since they form color images by a coupling reaction with the oxidation product of a primary aromatic amino color developing agent and, at the same time, the dye moiety is released from the molecule as a diffusible dye which determines the spectral absorption characteristics of the colored coupler itself. However, it was found that when couplers of this kind were present in the silver halide photographic emulsion layers of a color photographic material, they reduced the sensitivity of the silver halides in the emulsion layers during the storage of the color photographic material before or after exposure.

SUMMARY OF THE INVENTION

An object of this invention is to provide a multilayer color photographic material having a high masking effect and excellent color reproducibility.

Another object of this invention is to provide a multilayer color photographic material showing less reduction in sensitivity during storage thereof before or after exposure.

Still another object of this invention is to provide a color negative photographic film in which the component of a cyan dye showing an undesirable side absorption has been effectively masked and which shows excellent color reproduction of red, yellow, etc.

A further object of this invention is to provide a multilayer color negative photographic material which gives a color print having a sharp image and less color turbidity.

Another object of this invention is to provide a highly sensitive color photographic element which has no absorption of effective light due to colored coupling compounds.

It has been found that these objects of this invention can be attained by the multilayer color photographic material of this invention. That is, according to this invention, there is provided a multilayer color photographic material fundamentally comprising a support having coated thereon a red-sensitive silver halide emulsion layer, a green-sensitive silver halide emulsion layer, and an optional a yellow filter layer and blue-sensitive silver halide emulsion layer, the color photographic material further having formed between the support and the red-sensitive silver halide emulsion layer a non-sensitive auxiliary layer containing one or more non-diffusible colored coupling compounds which release, upon coupling with the oxidation product of a primary aromatic amino color developing agent, a diffusible dye capable of being removed from the photographic layer.

If the red-sensitive silver halide emulsion layer is composed of at least two layers having different sensitivities, the non-diffusible colored coupling compound(s)-containing layer can be at least one layer selected from the group consisting of; (1) a non-sensitive auxiliary layer between the support and the red-sensitive silver halide emulsion layer; (2) a non-sensitive auxiliary layer between the red-sensitive silver halide emulsion layer and the green-sensitive silver halide emulsion layer; and (3) a red-sensitive silver halide emulsion layer having a high sensitivity.

DESCRIPTION OF THE PREFERRED EMBODIMENTS

Figure 1A:
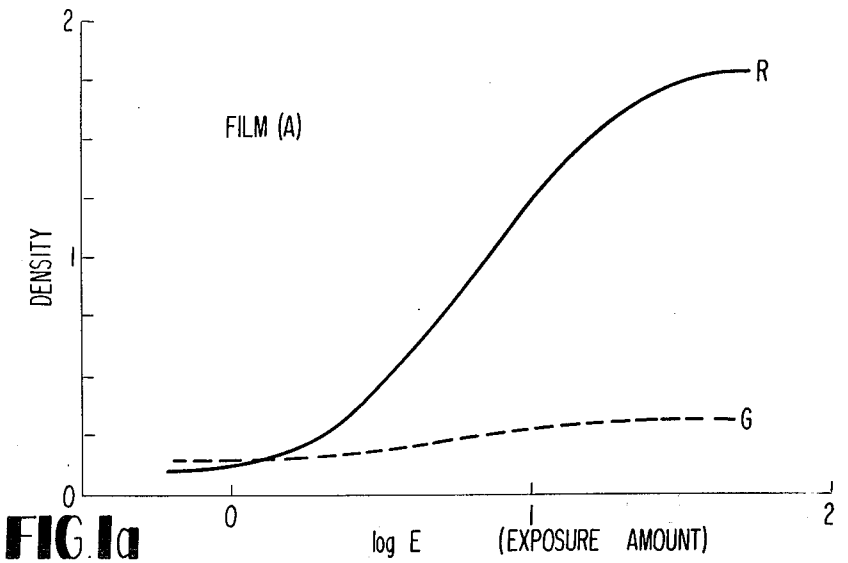
FIGS. 1(*a*), (*b*), (*c*) and (*d*) are each sensitometric characteristic curves, in which curve R stands for the cyan dye image density and curve G stands for the magenta dye image density.
Figure 1B:
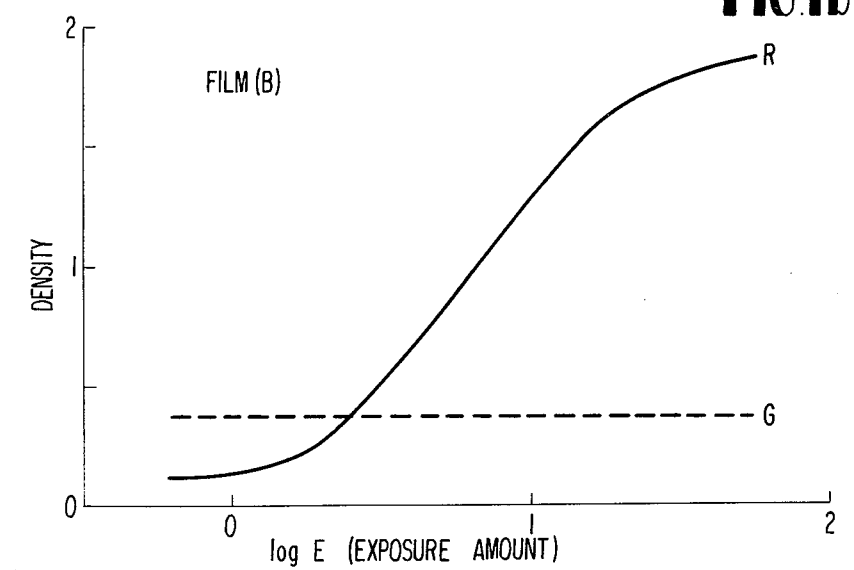
Figure 1C:
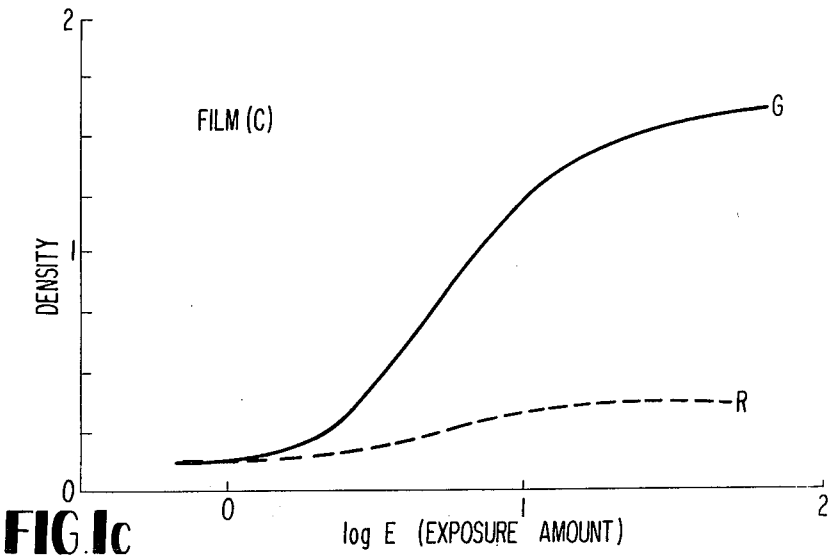
Figure 1D:
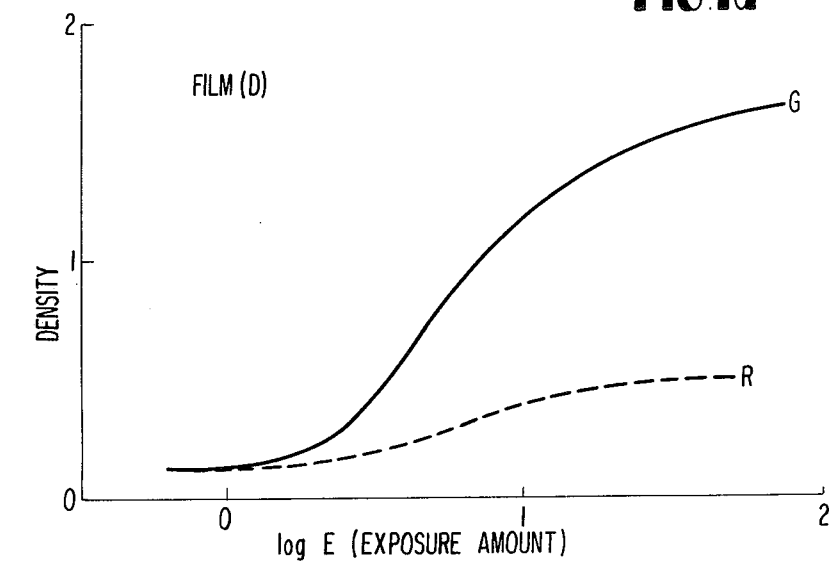

The colored coupling compound used in this invention is a compound which is red before coupling and forms a substantially colorless or cyan dye after coupling, and is shown by General Formula 1:

General Formula 1:

[C] – L – [DD]

wherein [C] represents a non-diffusible coupling compound residue, and the —L—[DD] is bonded to the coupling position of the colored coupling compound, [DD] represents a diffusible dye residue, —L— represents a coupling group between the non-diffusible coupling compound residue [C] and the diffusible dye residue [DD], and —L—[DD] represents a residue which is released at the oxidative coupling of the compound [C]—L— [DD] with a primary aromatic amino color developing agent and can be diffused from the photographic layer during processing of the color photographic material.

Preferred [C] moieties include a residue having an active site capable of reacting with an aromatic primary amine developing agent (e.g., a residue having an active methylene group which may be an open chain or closed chain residue, e.g., a cyan color-forming residue containing a phenol or α-naphthol nucleus).

Specific examples of preferred [C] residues are the coupling compound residues possessing non-diffusible groups as described in U.S. Pat. Nos. 2,920,961; 2,875,057; 3,418,129; 3,658,544; 3,681,076; 3,062,653; 2,474,293; and 2,895,826; British Pat. No. 1,201,943; German Offenlegungsschrift No. 2,216,578; and Japanese Patent Applications Nos. 35,379/1973 and 69,383/1973. Other examples of these coupling compound residues are the non-diffusible coupler residues described in U.S. Pat. Nos. 2,369,929; 3,474,293; 3,591,383; 3,458,315; 3,311,476; 3,419,390; 3,476,563; and 3,253,924; British Pat. No. 1,201,110; U.S. Pat. Nos. 2,600,783; 3,558,319; 3,468,666; 3,419,391; 3,311,476; 3,253,924; 3,311,476; British Pat. No. 1,293,640; Japanese Patent Applications Nos. 21,454;1973 and 45,971/1973; U.S. Pat. Nos. 3,265,506; 2,728,658; 3,369,895; 3,582,322; 3,408,194; 3,415,652; and 3,253,924; British Pat. Nos. 1,286,411; 1,040,710; 1,302,398; and 1,204,680; German Offenlegungsschriftens Nos. 1,056,281; 2,162,899; and 2,213,461; Japanese Patent Application No. 3,039/1972; British Pat. Nos. 861,138; 914,145; and 1,109,963; Japanese Patent Publication No. 14,033/1970; U.S. Pat. No. 3,580,722; and "Mitteilungen aus den Forschungs Laboratorien der Agfa Leverkusen"; Vol. 4, 352–365 (1964), and the non-diffusible uncolored coupling compound residues as described in U.S. Pat. Nos. 3,632,345 and 3,227,554 and German Offenlegungsshrifts Nos. 2,359,295; 2,362,752; and 2,405,442.

Preferred examples of [DD] are the diffusible dye residues having a known dye moiety possessing a maximum absorption in the wavelength region of about 500 m.μ. to about 600 m.μ., such as an azo dye, an indoaniline dye, an indophenol dye, etc.

Preferred examples of —L— are an imide bond, a carbonyloxy bond, a sulfinyl bond, a sulfonyl bond, an ether bond, an imino bond, a sulfonyloxy bond, a sulfoamido bond, an amido bond, a carbamoyloxy bond, and a thioether bond (e.g., the bonds as described in U.S. Pat. Nos. 3,458,315; 3,311,476; 3,622,328; 3,476,563; and 3,419,391; Japanese Patent Application No. 56,050/1973; British Pat. No. 1,040,710; U.S. Pat. No. 3,415,652; German Offenlegungsschrift No. 2,213,461; U.S. Pat. Nos. 3,730,722; 3,227,554; and 3,632,345; and German Offenlegungsschrift No. 2,424,946).

Preferred examples of group —L—[DD] in the compound of General Formula 1 are shown by General Formula 2, 3, or 4, although they are not limited to the embodiments shown by these formulae.

General Formula 2:

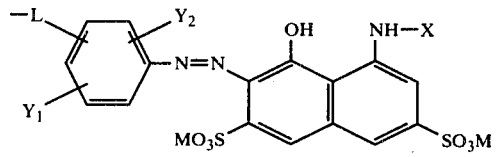

wherein L represents an oxygen atom, a sulfur atom, $—OCH_2CH_2O—$, $—OCH_2—$, $—OCH_2CH_2—$, $—OCH_2CHOHCH_2O—$, $—O-(CH_2)_3—O—$, $—O-(CH_2)_4—O—$, $—OCH_2CH_2—O—CH_2CH_2O—$, $—NHSO_2—$, $—NHSO_2-(CH_2)_3—O—$, $—NHSO_2-(CH_2)_4—$, $—OSO_2-(CH_2)O—$, $—OSO_2-(CH_2)_4—O—$, $—O—CO—NH—$, $—O—CO—$, $—O—COCH_2—$, or $—O—CO-(CH_2)_n—O—$ (wherein n is 0, 1, 2, 3, or 4), where these divalent groups are connected to the coupler constituting moiety at one side and to the dye moiety at their other side; X represents an acyl group having 1 to 8 carbon atoms or a sulfonyl group; $Y_1$ and $Y_2$ each represents a photographically inert group such as, for instance, a hydrogen atom, halogen atom (e.g., fluorine atom, chlorine atom, bromine atom, etc.,), hydroxyl group, cyano group, alkyl group (methyl group, tert-butyl group, octyl group, etc.), aralkyl group (e.g., benzyl group, etc.,), alkoxy group (e.g., methoxy group, tetradecyloxy group, etc.,), alkylthio group (e.g., methylthio group, dodecylthio group, etc.,), amido group (acetamido group, methanesulfonamido group, etc.,), and alkoxycarbonyl group (e.g., methoxycarbonyl group, etc.,); and M represents a hydrogen atom or a cation such as alkali metal ion, ammonium ion, etc.

General Formula 3:

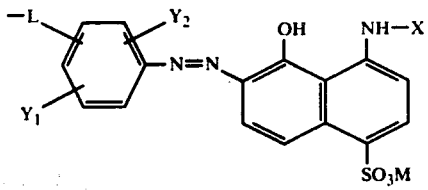

wherein L, X, $Y_1$, $Y_2$, and M have the same significance as in General Formula 2.

General Formula 4:

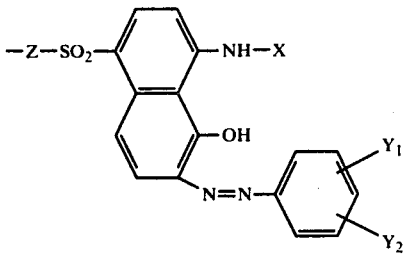

wherein X, $Y_1$ and $Y_2$ have the same significance as in General Formula 2 and Z represents an oxygen atom or —NH—.

Specific examples of the colored coupling compounds used in this invention are illustrated below but the colored coupling compounds used in this invention are not limited thereto.

Compound (1)

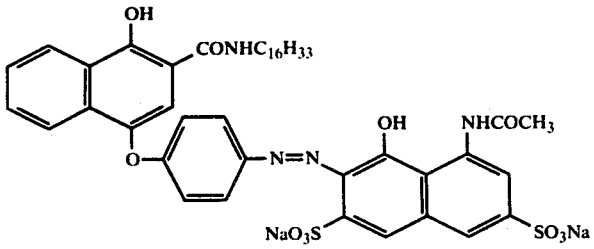

Compound (2)

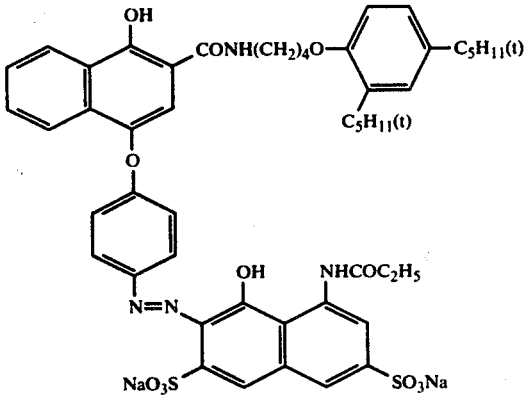

Compound (3)

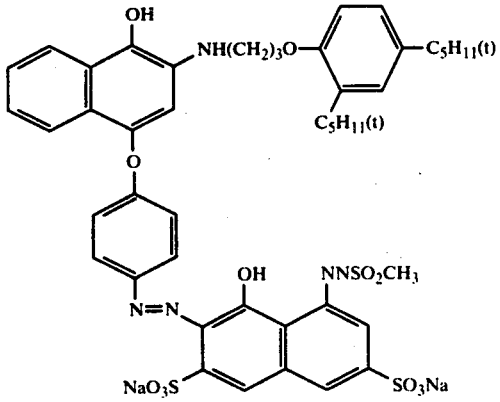

-continued
Compound (4)
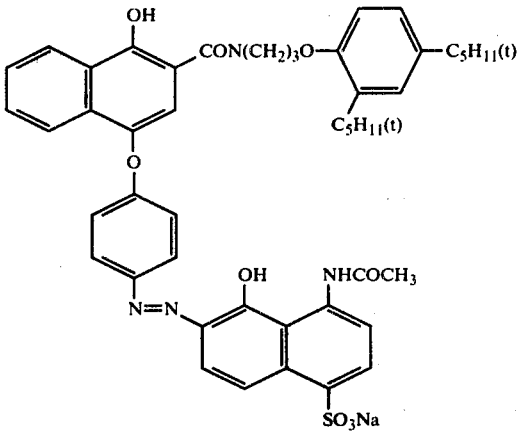
Compound (5)
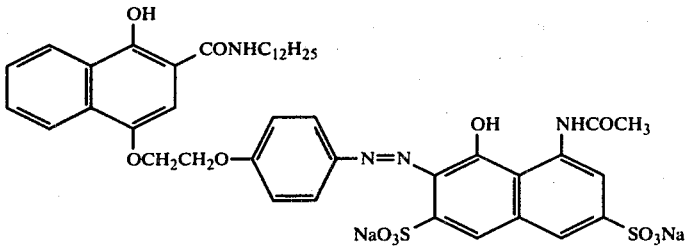
Compound (6)
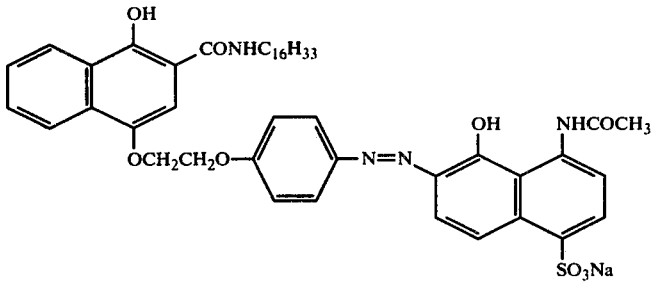
Compound (7)
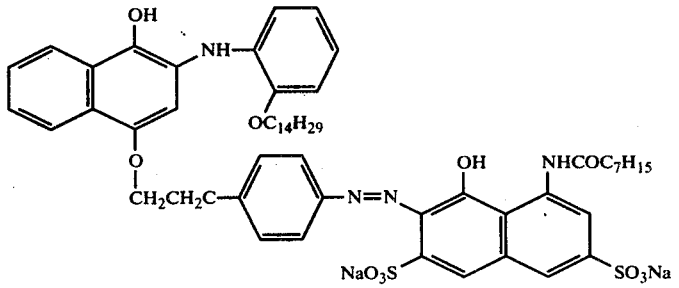
Compound (8)
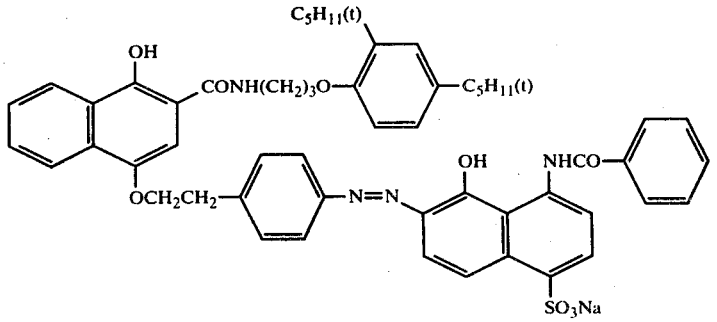

-continued
Compound (9)
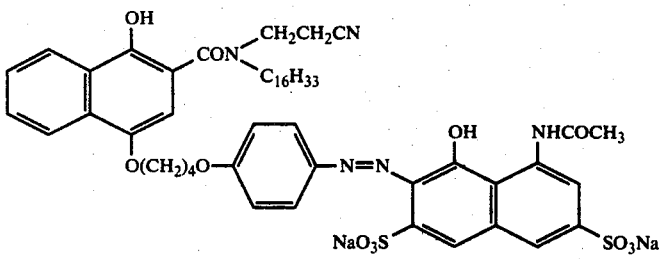
Compound (10)
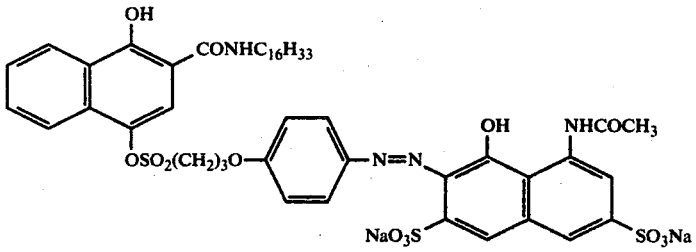
Compound (11)
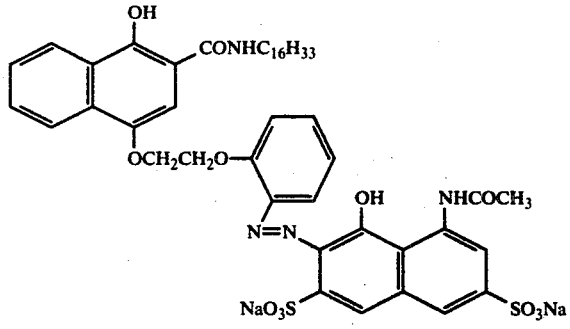
Compound (12)
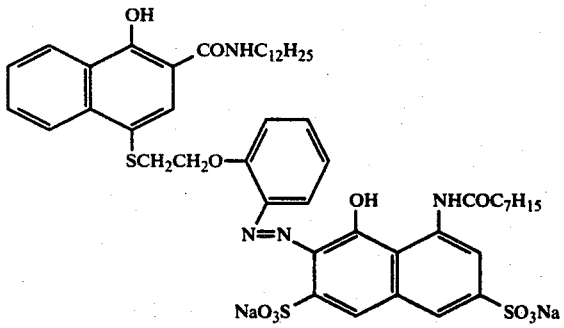
Compound (13)
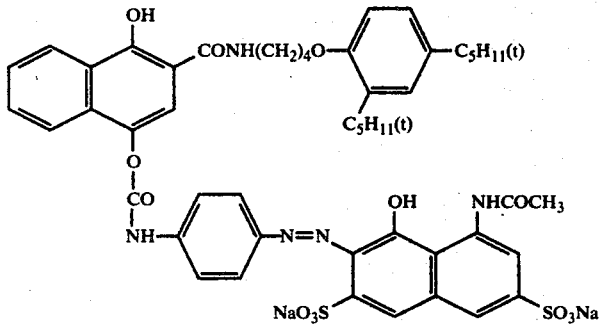

-continued
Compound (14)
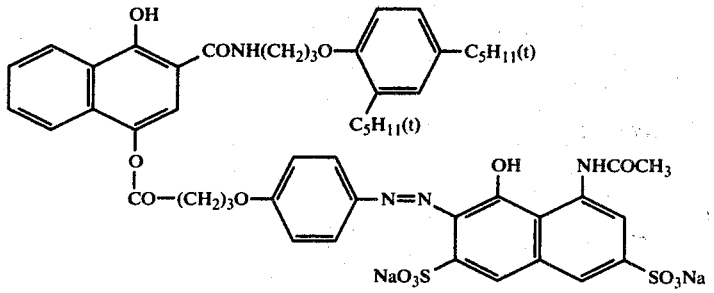
Compound (15)
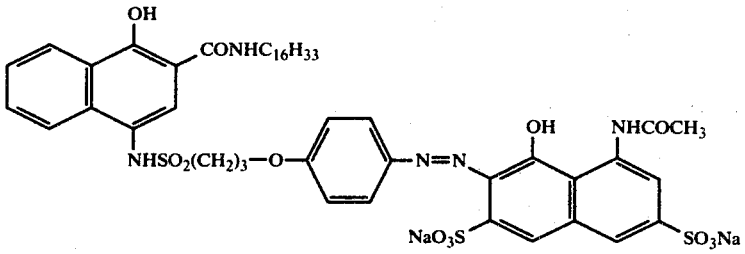
Compound (16)
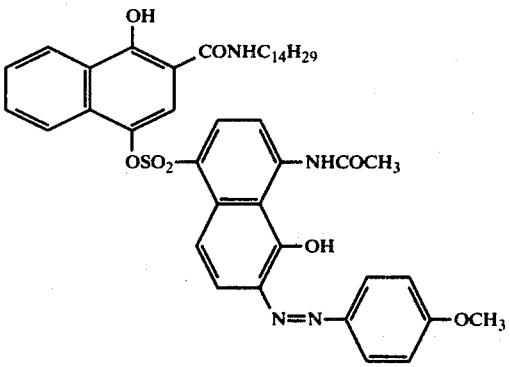
Compound (17)
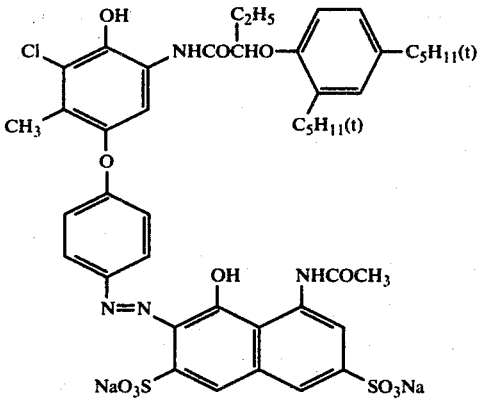
Compound (18)
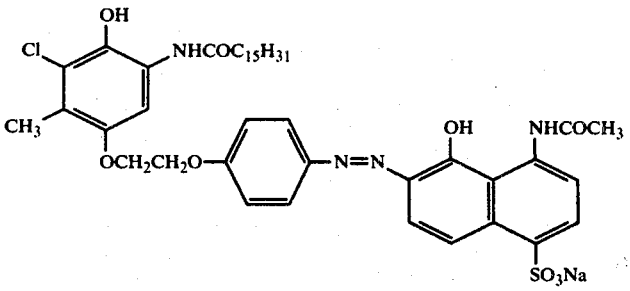

-continued
Compound (19)
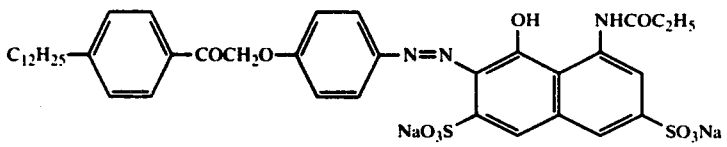
Compound (20)
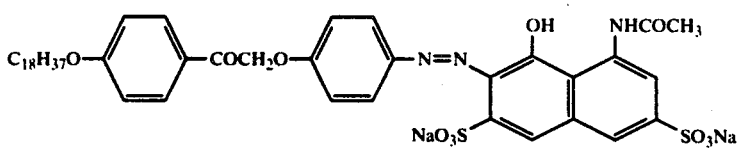
Compound (21)
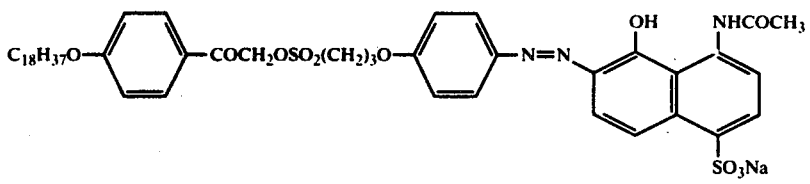
Compound (22)
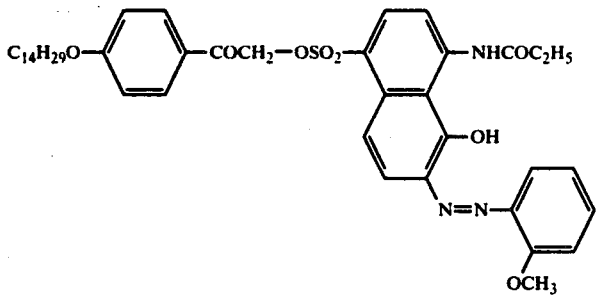
Compound (23)
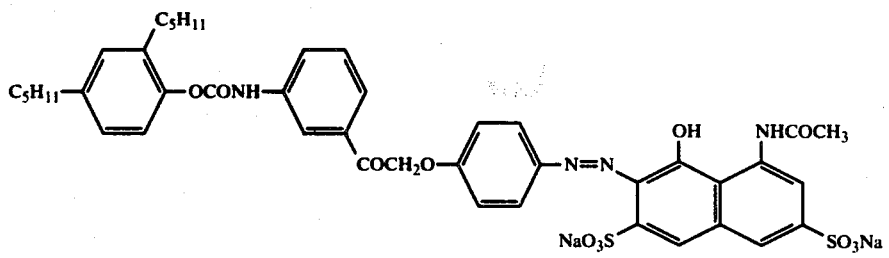
Compound (24)
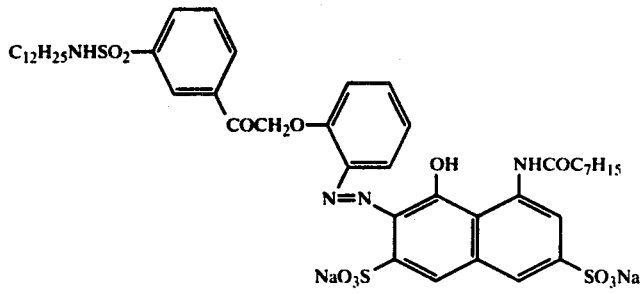

-continued
Compound (25)
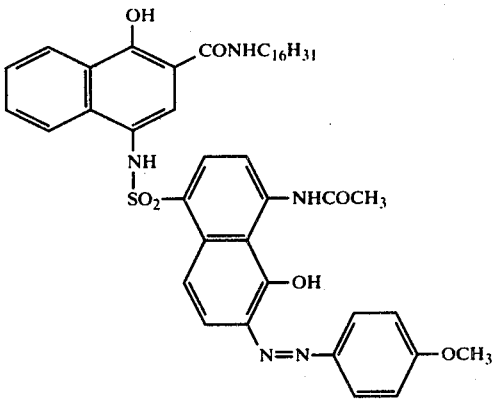
Compound (26)
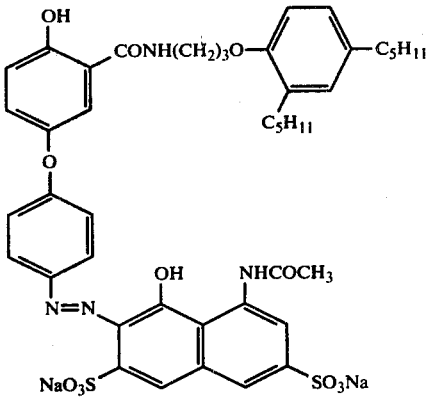
Compound (27)
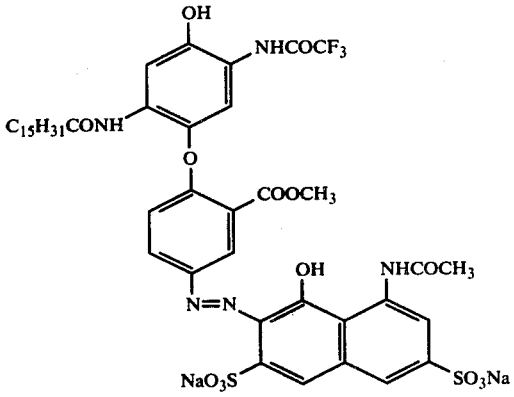
Compound (28)
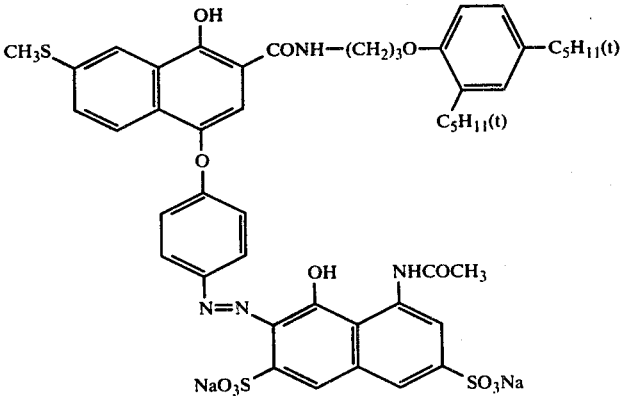

-continued
Compound (29)
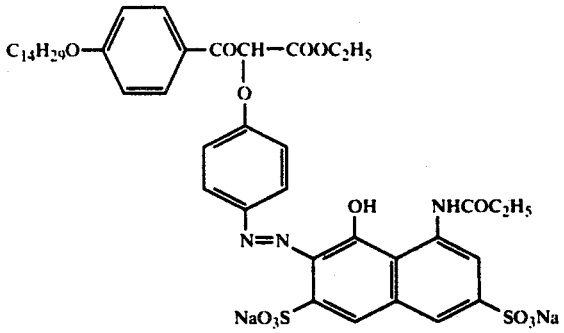
Compound (30)
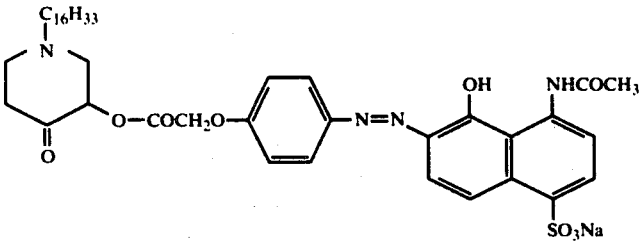
Compound (31)
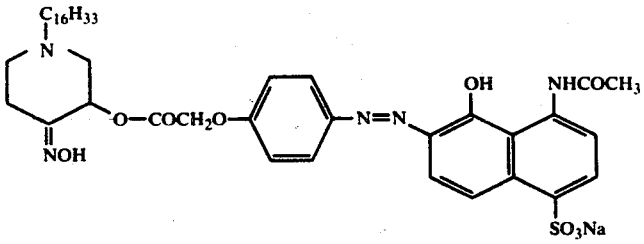
Compound (32)
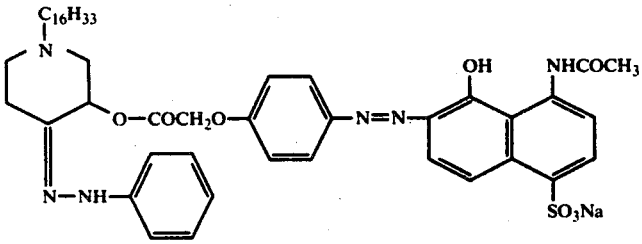
Compound (33)
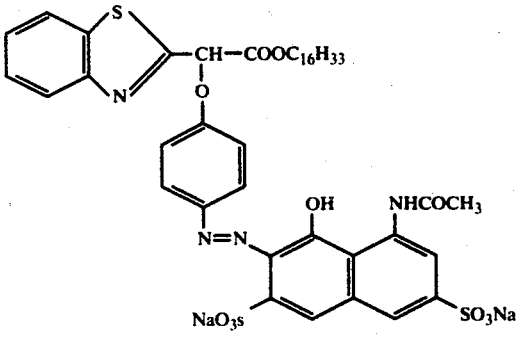
Compound (34)
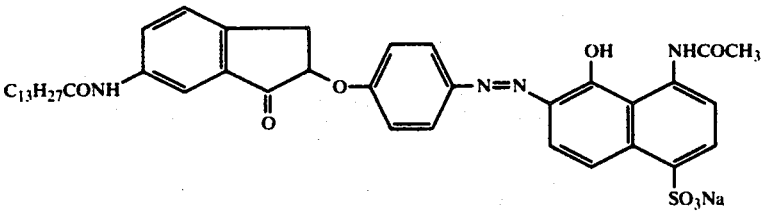

-continued

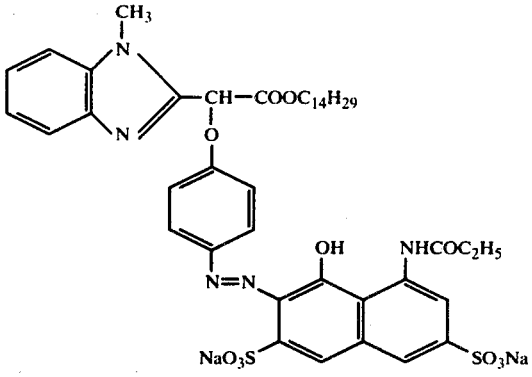

Compound (35)

The inventors have found that the above described objects of this invention can be attained by placing a layer containing one or more of such colored coupling compounds (hereafter referred to in the singular for purposes of brevity), but not containing photosensitive silver halide grains, between the red-sensitive silver halide emulsion layer and the support adjacent to the silver halide emulsion layer.

When the colored coupling compound described above is incorporated in a thin non-photosensitive layer formed between the red-sensitive silver halide emulsion layer and the support, the oxidation product of a primary aromatic amino color developing agent formed in the red-sensitive silver halide emulsion layer at development partially diffuses into the non-photosensitive auxiliary layer containing the colored coupling compound at development to cause a coupling reaction with the colored coupling compound, and, thus, a diffusible dye is image-wise released and then flows away from the photographic layer, which results in effecting color masking.

In the case that the red-sensitive silver halide emulsion layer is composed of two or more red-sensitive layers having different sensitivities, the non-diffusible colored coupling compound containing non-photosensitive layer can be disposed between the uppermost red-sensitive silver halide emulsion layer and the green-sensitive silver halide emulsion layer. The non-diffusible colored coupling compound of this invention can further be incorporated in the red-sensitive silver halide emulsion layer having the highest sensitivity of the red-sensitive silver halide emulsion layers when two or more of such red-sensitive silver halide emulsion layers are used. Thus, the places where the non-diffusible colored coupling compound of this invention can be present to attain the effect of preventing from undesired color mixing are as follows:

(1) in a non-photosensitive layer which contains no photosensitive silver halide grains disposed under a red-sensitive emulsion layer and in contact therewith on a support;

(2) in the most sensitive layer of two or more red-sensitive emulsion layers having different sensitivities; and (3) in a non-photosensitive layer containing no light-sensitive silver halide grains disposed between a red-sensitive emulsion layer and a green-sensitive emulsion layer.

The colored coupling compound of this invention can be present in any one of the layers of (1), (2) and (3) above. The colored coupling compound can also be present in the layers of (1) plus (2), (1) plus (3), (2) plus (3) or (1) plus (2) plus (3).

The term "a red-sensitive silver halide emulsion layer having a high (or higher, etc.) sensitivity" is sometimes also referred to as "a highly-sensitive red-sensitive emulsion layer", both of which mean a red-sensitive emulsion layer having a relatively high sensitivity among two or more red-sensitive emulsion layers having different sensitivities. One can easily determine the highly-sensitive red-sensitive emulsion, but generally it comprises silver iodobromide grains having a mean grain size of greater than 0.5$\mu$ up to about 20$\mu$.

The multilayer color photographic material of this invention is particularly suitable for use as a highly-sensitive multilayer color negative photographic material.

The colored coupling compound used in this invention is generally soluble in water and thus is added as an aqueous solution thereof. In this case, the colored coupling compound may be dissolved in water in the presence of a surface active agent, an auxiliary solvent such as ethyl acetate, ethanol, etc., or an alkaline material (NaOH, $Na_2CO_3$, etc.).

The aqueous solution of the colored coupling compound of this invention is coated as a mixture of an aqueous solution of a hydrophilic organic colloid such as, e.g., gelatin, and in this case, it is preferred that the optical density of the coated coupling compound at the absorption peak wave length be about 0.05 to about 1.0. Also, the ratio of the colored coupling compound to the hydrophilic colloid, typically gelatin, is usually, by weight, about 1/1 to about 1/200, preferably 1/3 to 1/100. This general range applies if the color coupling compound of the present invention is present in an auxiliary layer or in a red-sensitive emulsion layer of higher sensitivity, or if it is present in one or more layers.

It is preferred from a practical standpoint that the coated amount of the non-diffusible colored coupling compound be about $7 \times 10^{-5}$ to about $20 \times 10^{-5}$ mol/m$^2$, more preferably about $7 \times 10^{-5}$ to about $15 \times 10^{-5}$ mol/m$^2$. The colored coupling compound of this invention can be present in two or more layers as described above, whereby the desired effects are obtained as long as the total amount of the colored coupling compound is in the preferred range set out above.

When one wants to use a relatively large amount (e.g., $10 \times 10^{-5}$ mol/m$^2$ or more) of the colored coupling compound in a single layer, it is preferred that the colored coupling compound be incorporated in a non-sensitive auxiliary layer disposed between the support and a red-sensitive silver halide emulsion layer. If a non-sensitive auxiliary layer containing such a large amount of the colored coupling compound of this invention is disposed adjacent the red-sensitive silver halide emulsion layer and the support side, or usually between the red-sensitive silver halide emulsion layer and a green-sensitive silver halide emulsion layer for forming a magenta dye image by color development, a part of the oxidation product of a primary aromatic amino color developing agent formed in the green-sensitive silver halide emulsion layer at development tends to diffuse into the auxiliary layer to undergo a coupling reaction with the colored coupling compound and to form a mask corresponding to the magenta dye image. Furthermore, when, in such a case, the colored coupling compound is a colored cyan coupler for forming a cyan dye image, a cyan dye is formed at the portion corresponding to the magenta dye image, which causes inconvenient color mixing. Moreover, when an auxiliary layer containing such a large amount of the colored coupling compound is disposed between the green-sensitive emulsion layer and the red-sensitive emulsion layer, the auxiliary layer hinders light from sufficiently reaching the red-sensitive silver halide emulsion layer to undesirably cause a reduction in apparent sensitivity of the red-sensitive silver halide emulsion layer.

As described above, when the colored coupling compound is present in a single layer, it is preferred that the colored coupling compound be incorporated in a non-sensitive auxiliary layer between the support and the red-sensitive emulsion layer, but not in a non-sensitive auxiliary layer alone disposed between the red-sensitive emulsion layer and the green-sensitive emulsion layer, or in the red-sensitive emulsion layer alone. While the place where the colored coupling compound is present has some preference in a single layer in which it is incorporated, the amount of colored coupling compound can properly be chosen so as to avoid color mixing (generally less than $5 \times 10^{-5}$ mol/m$^2$ in a red-sensitive layer), or can, of course, be shared in two or more layers so that the amount of the colored coupling compound can be reduced in the red-sensitive emulsion layer or in a non-sensitive auxiliary layer between the support and the red-sensitive emulsion layer.

It was also found that a remarkable decrease of sensitivity during storage was observed in a low sensitivity red-sensitive silver halide emulsion comprising small silver halide grains (mean grain size: about 0.1 to 0.5$\mu$) when the colored coupling compound of this invention was incorporated in such a silver halide emulsion layer, but when a highly sensitive red-sensitive silver halide emulsion was used, the decrease of sensitivity was slight. Accordingly, the case that a red-sensitive silver halide emulsion layer is composed of two or more emulsion layers having different sensitivities, the colored coupling compound can be directly incorporated into the higher (or highest) sensitivity red-sensitive emulsion layer alone.

In the present invention, the problem that green light is scattered at the interface with the red-sensitive emulsion layer or in the red-sensitive emulsion layer and goes back to the green-sensitive emulsion layer again to decrease the sharpness of the green image can also be minimized, since green light transmitted through the green-sensitive emulsion layer is absorbed by the colored coupling compound.

As mentioned above, the coating composition of the colored coupling compound of this invention may contain one or more surface active agents. Such surface active agents are used as a coating aid but in some cases they are also used for other purpose such as for improving photographic properties and as antistatic agents. Examples of the surface active agents used for the purposes are natural surface active agents such as saponin, etc.; nonionic surface active agents such as alkylene oxides, glycerols, glycidols, etc., cationic surface active agents such as higher alkylamines, quaternary ammonium salts, pyridine and other heterocyclic compounds, phosphoniums, sulfoniums, etc., anionic surface active agents such as surface active agents having an acid group such as a carboxylic acid group, a sulfonic acid group, a phosphoric acid group, a sulfuric acid ester group, a phosphoric acid ester group, etc., and amphoteric surface active agents such as aminoacids, aminosulfinic acids, sulfuric acid esters or phosphoric acid esters of amino alcohols, etc.

Specific examples of useful surface active agents are described in U.S. Pat. Nos. 2,271,623; 2,240,472; 2,288,226; 2,739,891; 3,068,101; 3,158,484; 3,201,253; 3,210,191; 3,294,540; 3,415,649; 3,441,413; 3,442,654; 3,475,174; 3,545,974; German Offenlegungsschrift No. 1,942,665; British Pat. Nos. 1,077,317 and 1,198,450; Ryohei Oda; "Synthesis and Application of Surface Active Agents", published by Maki Shoten in 1964; A. W. Perry; "Surface Active Agents", published by Inter Science Publications Inc. in 1958; and J. P. Sisley; "Encyclopaedia of Surface Active Agents", Vol. 2, published by Chemical Publishing Co. in 1964.

The aforesaid coating composition may further contain a hardening agent to increase the strength of the coated layer. Examples of hardening agents used are, for instance, ketone compounds (such as diacetyl, cyclopentadione, etc.,), bis(2-chloroethylurea), 2-hydroxy-4,6-dichloro-1,3,5-triazine, compounds having a reactive halogen as described in U.S. Pat. Nos. 3,288,775 and 2,732,303; and British Pat. Nos. 974,723 and 1,167,207; divinylsulfone, 5-acetyl-1,3-diacryloylhexahydro-1,3,5-triazine; compounds having a reactive olefin group as described in U.S. Pat. Nos. 3,635,718 and 3,232,763 and British Pat. No. 994,869; the isocyanates as described in U.S. Pat. No. 3,103,473; the aziridine compounds as described in U.S. Pat. Nos. 3,017,280 and 2,983,611; the acid derivatives as described in U.S. Pat. Nos. 2,725,294 and 2,725,295; the carbodiimide compounds as described in U.S. Pat. No. 3,100,704; the epoxy compounds as described in U.S. Pat. No. 3,091,537; the isoxazole compounds as described in U.S. Pat. Nos. 3,321,313 and 3,543,292; halogenocarboxyaldehydes such as mucochloric acid; dioxane derivatives such as dihydroxydioxane, dichlorodioxane, etc.; and inorganic hardening agents such as chromium alum, zirconium sulfate, etc. Furthermore, hardening agent precursors such as an alkali metal bisulfite-aldehyde addition product, a methylol derivative of hydantoin, etc., may be used in place of the aforesaid compounds.

The coating composition of the colored coupling compound used in this invention may further contain a light absorbing material and a filter dye as described in U.S. Pat. No. 3,547,640, and, if desired or necessary, the dye may be mordanted.

The color negative photographic material of this invention in one embodiment is fundamentally composed of the following photographic layers, that is, the color photographic material of this invention comprises a support having coated thereon, in succession, a non-sensitive auxiliary layer, a red-sensitive silver halide emulsion layer (which may optionally be composed of two or more red-sensitive emulsion layers), an optional non-sensitive auxiliary layer, a green-sensitive silver halide emulsion layer, an optional a yellow filter layer and blue-sensitive silver halide emulsion layer, and an optional uppermost protective layer, the colored coupling compound of this invention being present in the layer(s) as earlier described.

In a commercial product, of course, a yellow filter layer and a blue-sensitive silver halide emulsion layer will be used.

If desired or necessary, an interlayer may be formed to prevent the occurrence of color mixing. Furthermore, each of the blue-sensitive emulsion layer and the green-sensitive emulsion layer may be composed two or more emulsion layers having the same or different sensitivities. Usually, the blue-sensitive emulsion layer contains a yellow dye image forming coupler (yellow coupler), the green-sensitive emulsion layer contains a magenta dye image forming coupler (magenta coupler), and the red-sensitive emulsion layer contains a cyan dye image forming coupler (cyan coupler), and, if desired or necessary, each of the emulsion layers may further contain a development inhibitor releasing compound such as a DIR coupler, a DIR hydroquinone, DIR decoloring coupling compound, etc., and the emulsion layer may contain a colored coupler.

The cyan coupler used in the red-sensitive silver halide emulsion layer of this invention may be selected in a very broad range of couplers, for instance, from the cyan couplers as described in U.S. Pat. Nos. 2,369,929; 3,591,383; 3,458,315; 2,474,293; 2,908,573; 3,419,390; 3,476,563; 3,253,924; 2,434,272; 3,516,831; 3,311,476; 2,698,974; 3,227,554; 3,701,783; 3,617,291; 3,622,328; and 2,908,573; Japanese Patent Publications Nos. 5547/1964; 6993/1970; 12,988/1963; 18,145/1963; 28,836/1970; and 19,032/1971; Japanese Patent Applications Nos. 35,379/1973 and 69,383/1973; and German Offenlegungsschriftens Nos. 2,216,578 and 2,163,811.

Furthermore, the red-sensitive silver halide emulsion layer may further contain the colored cyan couplers as described in U.S. Pat. Nos. 3,481,741; 3,459,552; 3,583,971; and 3,034,892 and Japanese Patent Application No. 3113/1974.

Examples of the magenta coupler used in the green-sensitive silver halide emulsion layer of this invention are those described in U.S. Pat. Nos. 3,253,924 and 3,516,931; Japanese Patent Application (OPI) No. 5482/1972; U.S. Pat. Nos. 2,600,788; 3,558,319; and 2,439,098; Japanese Patent Application No. 21,454/1973; British Pat. No. 1,293,640; U.S. Pat. Nos. 3,468,666 and 3,419,391; Japanese Patent Application No. 56,050/1973; U.S. Pat. Nos. 3,311,476 and 3,061,432; Japanese Patent Publication No. 2016/1969; Japanese Patent Application No. 33,238/1973; U.S. Pat. Nos. 3,148,062 and 2,908,573; Japanese Patent Application Nos. 35,379/1973 and 69,383/1973; Japanese Patent Publication No. 19,032/1971; German Offenlegungsschrift No. 2,216,578; U.S. Pat. Nos. 3,227,554; 3,701,783; and 3,617,291.

The green-sensitive silver halide emulsion layer may further contain a colored magenta coupler and preferred examples of the colored magenta coupler used in this invention are described in U.S. Pat. Nos. 2,434,272 and 3,703,375; Japanese Patent Publication No. 2016/1969; U.S. Pat. No. 3,476,564; Japanese Patent Application No. 45,971/1973; and U.S. Pat. No. 3,476,560. Specific examples of particularly preferred colored magenta couplers used in this invention are 1-(2,4,6-tri-chlorophenyl)-3-[3-(2,4-di-tert-amylphenoxyacetamido)-benzamido]-4-(4-methoxyphenylazo)-2-pyrazoline-5-on, 1-2,4,6-trichlorophenyl)-3-[3-α-(2,4-di-tert-amylphenoxy)pentylamido benzamido]-4-(4-methoxyphenylazo)-2-pyrazoline-5-on, and 1-(2,4,6-trichlorophenyl)-3-(2-chloro-5-tetradecanoylamidoanilino)-4-(4-hydroxy-3-methylphenylazo)-2-pyrazoline-5-on.

The yellow couplers used in the blue-sensitive silver halide emulsion layer of this invention may be selected from the couplers as described in U.S. Pat. No. 3,253,924; Japanese Patent Publication No. 18,735/1964; U.S. Pat. No. 3,265,506; British Pat. No. 1,286,411; U.S. Pat. Nos. 2,728,658; 3,369,895; and 3,582,322; German Offenlegungsschriftens Nos. 1,956,281 and 2,162,899; U.S. Pat. Nos. 3,408,194; 3,447,928; and 3,415,652; German Offenlegungsschrift No. 2,213,461; Japanese Patent Application No. 3039/1972; British Pat. No. 1,302,398; British Pat. No. 1,204,680; U.S. Pat. Nos. 3,510,306 and 2,908,573; Japanese Patent Applications Nos. 35,379/1973 and 69,383/1973; Japanese Patent Publication No. 19,032/1971; German Offenlegungsschrift No. 2,216,578; and U.S. Pat. Nos. 3,148,062; 3,227,554; and 3,701,783.

Moreover, as described above, each of the silver halide emulsion layers may further contain a so-called DIR coupler, that is, a coupler which releases a development inhibitor at coupling reaction or a DIR compound, that is, a compound which releases a development inhibitor at coupling reaction. Examples of these couplers and compounds are described in U.S. Pat. Nos. 3,148,062; 3,227,554; 3,253,924; 3,617,291; 3,622,328; 3,705,201; 3,297,445; 3,379,529; and 3,639,417 and British Pat. No. 1,201,110.

The DIR couplers and/or the DIR compounds in the red-sensitive emulsion layer, the green-sensitive emulsion layer, and/or the blue-sensitive emulsion layer of the color photographic material of this invention may be added to the emulsion layers by utilizing the methods as described in U.S. Pat. no. 3,703,375; Japanese Patnt Publications Nos. 28,836/1970 and 19,034/1971; Japanese Patent Applications Nos. 50,051/1973; 68,892/1973; and 87,723/1973; and German Offenlegungsschriftens Nos. 2,060,196 and 2,322,165. Also, it is preferred to employ the technique described in U.S. Pat. No. 3,737,317; and Japanese Patent Application Nos. 103,542/1973 and 113,633/1973 as the construction for the auxiliary layers when the DIR couplers and/or the DIR compounds are used.

The aforesaid couplers may be used as a combination of two or more kinds thereof or the same kind of coupler may be incorporated in two or more emulsion layers to provide the characteristics required for the color photographic material.

The coupler used in each light-sensitive silver halide emulsion layer of this invention may be dissolved in an oily solvent such as tricresyl phosphate and the solution then dispersed by emulsification in an aqueous solution of gelatin or the like in the presence of a surface active agent. This technique is also described in the aforesaid patents.

The silver halide emulsion used in this invention is usually prepared by mixing an aqueous solution of a water soluble silver salt such as silver nitrate and an aqueous solution of a water soluble halide such as potassium bromide in the presence of an aqueous solution of a water soluble polymer such as gelatin. Examples of the silver halide include those conventionally used in the art such as silver iodobromide, silver chloroiodo bromide, silver bromide, etc. The ratio of silver to gelatin in the silver halide emulsions used in this invention is usually from about 1/10 to about 5/1 by weight, preferably from 1/5 to 3/1 by weight, but this is not limitative. These silver halide grains may be prepared by any conventional manner. In this case, a single jet method, a double jet method, or a controlled double jet method may of course be applied. It is preferred that the mean grain size of silver halide grains be about 0.1 to about 20 microns. As is described hereinbefore, a highly-sensitive red-sensitive silver halide emulsion layer in which the colored coupling compound of this invention can be incorporated preferably contains silver halide grains having a grain size of greater than 0.5μ up to about 20μ, preferably 0.6 to 5 μ, however. When utilizing silver halide grains of high sensitivity of such a particle size, it is preferred to use the same in combination therewith as the silver halide grains of low sensitivity silver halide grains having a grain size of equal to or less than 0.5μ and preferably equal to or greater than 0.1μ.

These silver halide emulsions may be prepared in a conventional manner such as an ammonia method, a neutralization method, an acid method, etc., as described in, for instance, C.E.K. Mees; "The Theory of the Photographic Process"; published by MacMillan Co., and P. Glafkides; "Chimie Photographique" published by Paul Montel Co. in 1957.

After formation of the silver halide grains, the silver halide emulsion containing them is washed with water to remove by-produced water soluble salts (for instance, potassium nitrate in the case of producing silver bromide from silver nitrate and potassium bromide) from the system and then subjected to a heat treatment in the presence of a chemical sensitizer such as sodium thiosulfate, N,N,N'-trimethylthiourea, a thiocyanate complex salt of monovalent gold, a complex salt of a thiosulfate, stannous chloride, hexamethylene tetramine, etc., whereby the sensitivity of the silver halide emulsion is increased without increasing the grain size of the silver halide grains. Such a sensitization method is also described in the above cited texts.

Examples of the hydrophilic colloid used as the vehicle for the silver halide emulsions used in this invention are gelatin, colloidal albumin, casein, cellulose derivatives such as carboxymethyl cellulose, hydroxyethyl cellulose, etc., agar-agar, sodium alginate, starch derivative, synthetic hydrophilic colloids such as polyvinyl alcohol, poly-N-vinylpyrrolidone, polyacrylic acid copolymers, polyacrylamide, etc., and the derivatives and partially hydrolyzed products of these synthetic hydrophilic colloids. If desired or necessary, a mixture of two or more such compatible colloids can be employed as the vehicle. Among these hydrophilic colloids, gelatin is most generally used but it may be partially or wholely replaced by a synthetic polymer or a gelatin derivative, that is, gelatin modified by treating the functional groups such as an amino group, imino group, hydroxyl group, or carbonxyl group of the gelatin molecule with a reagent having a group capable of reacting with such functional groups, or further a graft polymer prepared by grafting a molecular chain of an other polymer onto gelatin may be used.

The silver halide photographic emulsion used as the red-sensitive photographic emulsion layer is rendered red-sensitive by adding thereto a panchromatic sensitizing dye as described in, for example, Japanese Patent Publication No. 10,773/1968; U.S. Pat. Nos. 3,511,664; 3,522,052; 3,527,641; 3,615,613; 3,615,632; 3,617,295; 3,635,721; and 3,694,217; and British Pat. Nos. 1,137,580 and 1,216,203.

Also, the silver halide emulsion for the green-sensitive silver halide emulsion layer is rendered green-sensitive by adding thereto the orthochromatic sensitizing dyes as described in, for example, U.S. Pat. Nos. 2,688,545; 2,912,329; 3,397,060; 3,615,635; 3,628,964; 3,793,020; 3,656,959; and 3,769,301; German Offenlegungschriftens Nos. 2,030,326, and 2,121,780; and Japanese Patent Publications Nos. 14,030/1969 and 4936/1968.

Furthermore, to increase the sensitivity of the blue-sensitive silver halide emulsion layer, the silver halide emulsion may further contain, for example, the sensitizing dyes as described in U.S. Pat. Nos. 2,493,748; 2,519,001; 2,977,229; 3,480,434; 3,672,897; and 3,703,377.

To the silver halide emulsions there may further be added various conventional additives to prevent a reduction in sensitivity or the occurrence of fog during the production, storage, and processing of the photographic materials. Examples of these additives are 4-hydroxy-6-methyl-1,3,3a,7-tetraazaindene, 3-methylbenzothiazole, 1-phenyl-5-mercaptotetrazole, and further various hetercyclic compounds, mercury-containing compounds, mercapto compounds, and metal salts. Specific examples of these additives used in this invention are descrived in C. E. K. Mees; "The Theory of the Photographic Process"; 3rd edition, page 344, 1966 as well as in U.S. Pat. Nos. 1,758,567; 2,110,178; 2,131,038; 3,173,628; 2,697,040; 2,304,962; 2,324,123; 2,394,198; 2,444,605; 2,444,606; 2,444,607; 2,444,608; 2,566,245; 2,694,716; 2,697,099; 2,708,162; 2,728,663; 2,728,664; 2,728,665; 2,476,536; 2,824,001; 2,843,491; 2,886,437; 3,052,544; 3,137,577; 3,220,839; 3,226,231; 3,236,652; 3,251,691; 3,252,799; 3,287,135; 3,326,681; 3,420,668; 3,622,339; and British Pat. Nos. 893,428; 403,789; 1,173,609; and 1,200,188.

The yellow filter layers used in this invention include these conventionally known as a yellow filter layers in the art. Usually they are a gelatin layer containing Carey Lee type yellow colloidal silver or a yellow dye.

The silver halide emulsions may further contain a surface active agent, hardening agent and a dye as earlier given with regard to the coating composition containing the colored coupling compound of this invention.

The support used is conventional; as the support for the multilayer color photographic materials of this invention, there can be illustrated a cellulose nitrate film, a cellulose acetate film, a cellulose acetate butyrate film, a cellulose acetate propionate film, a polystyrene film, a polyethylene terephthalate film, a polycarbonate film, etc. The support may be colorless or may be colored by the addition of a dye or pigment or by the application thereto of a colored subbing layer.

The aforesaid coating compositions can be coated on the support by various conventional coating methods such as dip coating, air knife coating, curtain coating and extrusion coating using the hopper as described in U.S. Pat. No. 2,681,294. If desired or necessary, two or more such photographic layers can be simultaneously coated by the method as described in U.S. Pat. Nos. 2,761,791; 3,508,947; 2,841,898; and 3,526,528.

The color photographic material of this invention can be processed by any conventional color photographic process. The processing can be performed at temperatures of 20° C. to 60° C. or higher temperatures.

The color developer used for the color development of the color photographic material is an alkaline aqueous solution containing a primary aromatic amino color developing agent (the pH of which is higher than about 8, preferably 9 to 13). Typical examples of the developing agent are p-phenylenediamine derivatives. Specific examples of the color developing agent are the inorganic acid salts of N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]aniline, 3-methyl-4-amino-N-ethyl-N-(β-hydrocyethyl)aniline, etc.; 4-amino-3-methyl-N-ethyl-N-(β-methanesulfoamidoethyl)aniline sesquisulfate monohydrate as described in U.S. Pat. No. 2,193,015; N-(2-amino-5-diethylaminophenylethyl)methanesulfoamide sulfate as described in U.S. Pat. No. 2,592,364; N,N-dimethyl-p-phenylenediamine hydrochloride; and 3-methyl-4-amino-N-ethyl-N-methoxyethylaniline as described in Japanese Patent Application (OPI) No. 64,933/1973.

These color developing agents are described in detail in L. F. A. Mason; "Photographic Processing Chemistry"; pp. 226–229, published by Focal Press, London in 1966. The color developing agent may also be used together with a 3-pyrazolidone.

After development, silver formed is converted into silver halide by conventional bleaching of the silver image and dissolved away in a conventional fixing treatment. The bleach process and the fix process may be performed simultaneously in a conventional blix bath, if desired.

The bleach solution contains an oxidizing agent. Typical examples of the oxidizing agent are a ferricyanide (e.g., potassium ferricyanide, sodium ferricyanide, ammonium ferricyanide, etc.,), a water soluble quinone (e.g., quinone, sulfophenylquinone, chloroquinone, methoxyquinone, 2,5-dimethoxyquinone, methylquinone, etc.,), a dichromate, nitrosophenol, a water soluble cupric salt (e.g., cupric chloride, cupric nitrate, cupric sulfate, etc.,), a water soluble cobalt (III) salt (e.g., cobalt (III) chloride, cobalt (III) nitrate, etc.,), a complex salt of an organic acid and a multivalent cation such as iron (III), cobalt (III), and copper (II) (e.g., the metal complex salts of ethylenediaminetetraacetic acid, nitrilotriacetic acid, iminodiacetic acid, malonic acid, tartaric acid, malic acid, diglycolic acid, dithioglycolic acid, etc., and a complex salt of copper and 2,6-dipicolic acid), a peracid (e.g., an alkyl peracid, persulfate, permanganate, hydrogen peroxide, etc.,), a hypochlorite, chlorine, bromine, and bleaching powder.

These bleaching agents are described in Japanese Patent Publications Nos. 14,035/1970; 13,944/1966; and 11,068/1966; U.S. Pat. Nos. 2,507,183; 2,529,981; 2,625,477; 2,748,000; 2,810,648; and 2,705,201 and British Pat. Nos. 982,984; 1,014,396; 1,032,024; 777,635; 717,139; and 1,111,313.

The fixing solution contains a silver halide solvent such as a water soluble thiosulfate (e.g., potassium thiosulfate, sodium thiosulfate, ammonium thiosulfate, etc.,), a water soluble thiocyanate (e.g., sodium thiocyanate, potassium thiocyanate, ammonium thiocyanate, etc.,), a water soluble sulfur containing diol fixing agent (e.g., 3-thia-1,5-pentadiol, 3,6-dithia-1,8-octanediol, 3,6,9-trithia-1,11-undecanediol, etc.,), a water soluble sulfur containing organic dibasic acid (e.g., ethylene-bis-thioglycolic acid, thioglycolic acid, etc.,), and the alkali metal salts of these dibasic acids.

The color developer, bleach solution, and fix solution used for processing the color photographic materials of this invention may contain conventional additives, if desired.

The processing steps may further include, if desired or necessary, other steps such as a stop, a hardening, a stabilization, and a washing in addition to the aforesaid fundamental steps.

Thus, by providing a non-sensitive auxiliary layer containing a colored coupling compound, in particular a dye colored cyan coupler between a support and a red-sensitive silver halide emulsion layer of a silver halide color photographic material comprising essentially a support having coated thereon, in succession, a red-sensitive silver halide emulsion layer, a green-sensitive silver halide emulsion layer, a yellow filter layer, a blue-sensitive silver halide emulsion layer, and a protective layer according to the teaching of this invention, masking can be effectively applied to the cyan dye image formed in the red-sensitive emulsion layer at development to thereby provide a color print having clear red and yellow colors, and, furthermore, a reduction in photographic properties of the color photographic materials caused by the use of the colored coupling compound, in particular, a dye colored cyan coupler, during storage before and after exposure can be prevented.

The invention will now be further illustrated by the following non-limiting examples. Unless otherwise indicated, all percentages are by weight.

EXAMPLE 1

A coating composition of a colored coupling compound(Compound 5) was prepared by adding 100 ml of a 4% aqueous solution of the colored coupling compound and 50 ml of a 2% aqueous solution of 2-hydroxy-4,6-dichloro-s-triazine as a hardening agent for gelatin to 1,000 ml of a 5% aqueous solution of gelatin.

A red-sensitive photosensitive emulsion I was prepared by adding, in succession, 200 ml of a 0.03% methanol solution of the optical sensitizer shown below, 20 ml of a 1% aqueous solution of 5-methyl-7-hydroxy-1,3,4-triazaindolizine, 450 g of an emulsion of the colorless cyan coupler shown below (the emulsion was prepared in the manner shown below), and 50 ml of a 2% aqueous solution of 2-hydroxy-4,6-dichloro-s-triazine sodium salt as a hardening agent for gelatin to 1,000 g of a highly-sensitive negative silver iodobromide emulsion containing 6.5 g of silver iodobromide (containing 6 mole% silver iodide per mole of silver, mean grain size 0.7μ) and 10 g of gelatin per 100 g of the emulsion.

The optical sensitizer used above was the compound shown by the following formula:

Optical sensitizer:

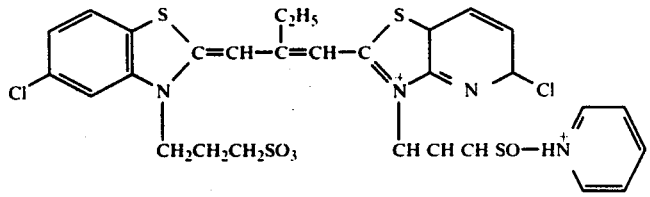

Also, the colorless cyan coupler used above was as follows:

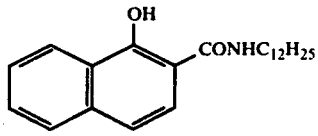

The emulsion of the colorless cyan coupler was prepared in the following manner:

| | | |
|---|---|---|
| Ethyl acetate | 110 | ml |
| Colorless cyan coupler (shown above) | 80 | g |
| Sodium p-dodecylbenzenesulfonate | 5 | g |
| Tricresyl phosphate | 65 | ml |

A mixture of the above components was heated to 60° C. to dissolve the solid components, and, after adding the solution to 1,000 ml of a 10% aqueous solution of gelatin maintained beforehand at 60° C., the mixture was stirred for 20 minutes by a mixer to provide the emulsion.

A green-sensitive photosensitive emulsion II was prepared in the following manner.

1,000 g of a highly sensitive negative silver iodobromide emulsion containing 6.5 g of silver iodobromide (containing 6 mole% iodine) and 10 g of gelatin per 100 g of the emulsion was melted at 40° C. and then 200 ml of a 0.1% methanol solution of the green sensitizing dye having the following formula was added to the silver halide emulsion with stirring.

Green region sensitizing dye:

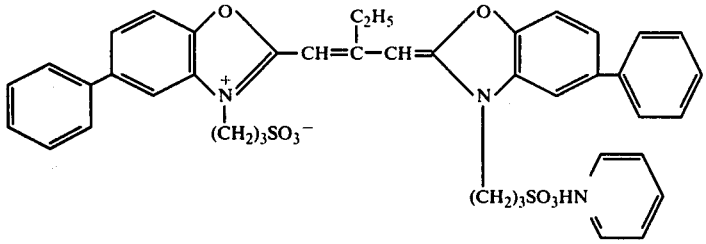

Then, to the silver halide emulsion thus prepared were added, in succession, 20 ml of a 1% aqueous solution of 5-methyl-7-hydroxy-1,3,4-triazaindolizine, 300 g of an emulsion of the magenta coupler of the following formula (the emulsion was prepared in the manner given below), and 50 ml of a 2% aqueous solution of 2-hydroxy-4,6-dichloro-s-triazine sodium salt as a hardening agent for gelatin to provide the green-sensitive photosensitive emulsion.

Magenta coupler:

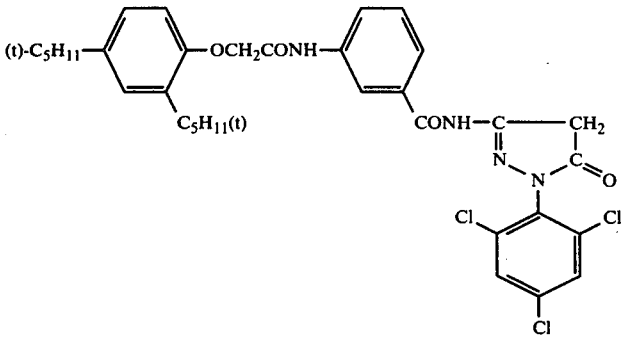

The emulsion of the magenta coupler was prepared in the following manner:

| | | |
|---|---|---|
| Ethyl acetate | 110 | ml |
| Magenta coupler (shown above) | 80 | g |
| Sodium p-dodecylbenzenesulfonate | 5 | g |
| Tricresyl phosphate | 65 | ml |

The mixture of the above components was heated to 60° C. to dissolve the solid components and then after adding to the solution 1,000 ml of a 10% aqueous solution of gelatin maintained beforehand at 60° C., the resultant mixture was stirred for 20 minutes by a mixer to provide the emulsion.

Then, color photographic films (A), (B), (C), or (D) were prepared by coating on a cellulose triacetate support the aforesaid gelatin solution containing the colored cyan coupler, the red-sensitive photosensitive emulsion I, and the green-sensitive photosensitive emulsion II using the constructions shown in Table 1.

| | Film (A) | Film (B) | Film (C) | film (D) |
|---|---|---|---|---|
| 1st layer | Red-sens. emulsion I | Gelatin solution of Compound 5* | Red-sens. emulsion I | Red-sens. emulsion I |
| 2nd layer | none | Red-sens. emulsion I | Gelatin solution | Gelatin solution of Compound 5* |
| 3rd layer | none | none | Green-sens. emulsion II | Green-sens. emulsion II |

*amount of Compound 5: $10 \times 10^{-5}$ mol/m$^2$.

In the above table 1, the 2nd layer of film (C) was formed by coating the aforesaid aqueous gelatin solution containing 2-hydroxy-4,6-dichloro-s-triazine sodium salt as a hardening agent for gelatin but without the colored coupling compound and was to prevent the occurrence of color mixing between the red-sensitive emulsion layer and the green-sensitive emulsion layer.

The 1st layer was formed on the support, and then the 2nd layer and the 3rd layer were formed successively thereon. Also, the coverage of silver of each silver halide emulsion layer was 20 mg/100 cm$^2$ and the dry thickness of the gelatin layer was 1 micron.

Films (A) and (B) were exposed to red light through a conventional grey wedge and films (C) and (D) were exposed to green light through a conventional grey wedge. Thereafter, the films thus exposed were subjected to the following color development process.

| Development process | Temp. | Time |
|---|---|---|
| Color development | 20° C. | 12 min |
| Stop bath | " | 4 min |
| Hardening bath | " | 4 min |
| Wash | " | 4 min |
| Bleach bath | " | 6 min |
| Wash | " | 4 min |
| Fix bath | " | 8 min |
| Wash | " | 8 min |
| Dry | | |

The compositions of the processing baths used in the above process were as follows:

| | | |
|---|---|---|
| Color developer | | |
| Benzyl alcohol | 5 | ml |
| Sodium hydroxide | 0.5 | g |
| Diethylene glycol | 3 | ml |
| Sodium hexametaphosphate | 2 | g |
| Sodium sulfite | 2 | g |
| Potassium bromide | 2 | g |
| 4-Amino-3-methyl-N-ethyl-N-(β-hydroxyethyl)aniline monosulfate | 5 | g |
| Metaboric acid | 0.5 | g |
| Metaboric acid sodium salt . $4H_2O$ | 77 | g |
| Water to make | 1 | liter |
| Stop solution | | |
| Sodium acetate | 30 | g |
| Glacial acetic acid | 8 | ml |
| Water to make | 1 | liter |
| Hardening solution | | |
| Sodium hexametaphosphate | 1 | g |
| Borax . $5H_2O$ | 20 | g |
| Formalin (37%) | 10 | ml |
| Water to make | 1 | liter |
| Bleach solution | | |
| Potassium ferricyanide | 30 | g |
| Ferrocyanide | 8 | g |
| Potassium bromide | 20 | g |
| Borax . $5H_2O$ | 15 | g |
| Boric acid | 5 | g |
| Dissodium ethylenediamine tetraacetate . $2H_2O$ | 1 | g |
| Water to make | 1 | liter |
| Fix solution | | |

-continued

| | | |
|---|---|---|
| Sodium hexametaphosphate | 1 | g |
| Sodium sulfite | 5 | g |
| Sodium thiosulfate | 150 | g |
| Acetic acid | 8 | ml |
| Water to make | 1 | liter |

The densities of the films thus developed were measured through a red filter and a green filter, and the characteristic curves shown in FIG. 1 of the accompanying drawings were obtained. FIGS. 1(*a*), (*b*), (*c*), and (*d*) for films (A)-(D), respectively, are the sensitometeric characteristic curves, in which curve R stands for the cyan dye image density and curve G stands for the magenta dye image density.

In FIG. 1-(*a*) and FIG. 1-(*b*), it is theoretically required that only cyan dye images be formed when the photographic film is exposed to red light, and thus the change of the magenta density shown by the dotted line in FIG. 1-(*a*) shows the change in the side absorption density of the magenta component of the cyan dye image formed. On the other hand, in FIG. 1-(*c*) and FIG. 1-(*d*), it is theoretically required that only magenta dye images be formed when the film is exposed to green light, and thus the change of the cyan density shown by the dotted line shows the change of the side absorption density of the cyan component of the magenta dye image.

As will be understood from a comparison of the results of film (A) and film (B), by forming a gelatin layer containing the colored cyan coupler of this invention between the support and the red-sensitive silver halide emulsion layer (film (B)), the green side absorption component of the cyan dye image formed in the red-sensitive silver halide emulsion layer was effectively masked. This is an unexpectedly remarkable effect.

On the other hand, as will be understood from a comparison of the results of film (C) and film (D), when the gelatin layer containing $10 \times 10^{-5}$ mol/m$^2$ of the colored cyan coupler was placed between the red-sensitive silver halide emulsion layer and the green-sensitive silver halide emulsion layer, in the case of green exposure a cyan dye was formed by a coupling reaction of the oxidation product of the primary aromatic amino color developing agent formed in the green-sensitive emulsion layer at development and the colored cyan coupler to increase color mixing.

That is, when the amount of the colored coupling compound is relatively large, it is most preferred to incorporate the colored coupling compound in the non-sensitive auxiliary layer disposed between the support and the red-sensitive silver halide emulsion layer alone, but not to directly incorporate it in the red-sensitive emulsion layer.

In addition, almost the same results were obtained when colored cyan couplers 1, 2, 7, 12, 16 and 26 were used in place of the colored cyan coupler 5 in the aforesaid example.

EXAMPLE 2

Red-sensitive silver halide emulsion III or IV was prepared in the same way as in the case of preparing the red-sensitive silver halide emulsion I in Example 1 except that 100 ml or 50 ml of a 4% aqueous solution of a colored coupling compound (Compound 6) of this invention was added to the silver halide emulsion, respectively.

Film (E) was prepared by coating the silver halide emulsion III thus prepared on a cellulose triacetate film support at a coverage of 20 mg/100 $cm^2$ of silver.

An aqueous gelatin solution containing a colored coupling compound (Compound 6) of this invention and the gelatin hardening agent used in Example 1 both in the amounts as were used in Example 1 was coated on a cellulose triacetate film (having a subbing layer) at a dry thickness of 1 micron, and then the red-sensitive silver halide emulsion IV or I (Example 1) was coated on the gelatin layer at a coverage of 20 mg/100 $cm^2$ of silver to provide film (F) and film (G), respectively. In this case, the coverage of the colored cyan coupler of film (F) was the same as that of film (E), and the coverage of the colored cyan coupler of film (G) was ½ of that of film (E).

Each of films (A), (E), (F), and (G) were exposed to red light through a continuous grey wedge, allowed to stand for one week at 30° C. and 80% relative humidity, and then subjected to the same color development process as in Example 1. The density of the dye image of each film was measured through a red filter, the sensitivity determined from the characteristic curve obtained, and the results compared with the case of developing the same kind of film directly after exposure, the results being shown in Table 2. The sensitivity in the Table is defined by the relative value of the logarithmic value of the exposure amount giving a density of fog density + 0.2.

Table 2

| | Sensitivity (a) when developed directly after exposure | Sensitivity (b) when developed 1 week after storage at 30°C., 80% RH | (a) − (b) Reduction in sensitivity |
|---|---|---|---|
| Film (A) | 1.60 | 1.57 | − 0.03 |
| Film (E) | 1.63 | 1.41 | − 0.22 |
| Film (F) | 1.63 | 1.48 | − 0.15 |
| Film (G) | 1.61 | 1.56 | − 0.05 |

As can be understood from the results shown in Table 2, when the colored coupling compound (Compound 6) of this invention was directly incorporated in the red-sensitive silver halide emulsion layer (Film (E): amount of Compound 6, $20 \times 10^{-5}$ mol/$m^2$), the latent image regression caused by storage of the color photographic film after exposure increased.

On the other hand, when the colored coupling compound was incorporated both in the gelatin layer disposed between the support and the red-sensitive silver halide emulsion layer (Film (F): amount of Compound 6, $10 \times 10^{-5}$ mol/$m^2$ each in both layers; the total amount of Compound was the same as in Film E), the occurrence of latent image regression decreased. When the colored coupling compound was incorporated in the non-sensitive auxiliary layer alone (Film (G), amount of Compound 6, $10 \times 10^{-5}$ mol/$m^2$ in the auxiliary layer), the occurrence of the latent image regression was not appreciably observed.

In addition, almost the same results were obtained when the above procedure was followed using colored coupling compounds 4, 20, 23, 24, 29, and 33 in place of compound 6.

EXAMPLE 3

Red-sensitive silver halide emulsions (V) and (VI) were prepared in the same manner as in the case of red-sensitive silver halide emulsions III and IV, respectively, in Example 2 using Compound 11 in place of colored coupling compound 6.

Film (H) was prepared by coating silver halide emulsion V on a cellulose triacetate film at a coverage of 20 mg/100 $cm^2$ of silver (amount of Compound 11: $20 \times 10^{-5}$ mol/$m^2$).

An aqueous gelatin solution containing the colored coupling compound (Compound 11) and the hardening agent for gelatin as was used in Example 1, both in the amounts as were used in Example 1, was coated on a cellulose triacetate film at a dry thickness of 1 micron and then the red-sensitive silver halide emulsions VI and I (Example 1) each was coated on the gelatin layer at a coverage of 20 mg/100 $cm^2$ of silver to provide film (I) and film (J), respectively. In this case, the coating amount of the silver halide emulsions was so adjusted in each case so that the coverage of the colored coupling compound of film (I) and film (J) had the same relationship as in Example 2.

Films (A) (prepared as in Example 1), (H), (I), and (J) were allowed to stand for one week at 30° C. and 80% relative humidity; the films were then exposed to red light through a continuous grey wedge and then subjected to the same color development as in Example 1. The density of the color image formed was measured through a red filter and the sensitivity was determined from the characteristic curve thus obtained. The values obtained were compared with those of the color images obtained after storing the films having the same structures as the aforesaid films in a refrigerator, the results being shown in the following Table 3.

Table 3

| | Sensitivity (a') of the film after storage in refrigerator | Sensitivity (b') of the film after storage for one week at 30°C., 80% RH | (a') − (b') Reduction in sensitivity |
|---|---|---|---|
| Film (A) | 1.57 | 1.55 | − 0.02 |
| Film (H) | 1.61 | 1.40 | − 1.21 |
| Film (I) | 1.60 | 1.47 | − 0.13 |
| Film (J) | 1.59 | 1.56 | − 0.03 |

As can be understood from the results shown in Table 3, when the colored cyan coupler 11 was directly incorporated in the red-sensitive emulsion layer, the reduction in sensitivity during storage became larger.

On the other hand, when the colored coupling compound was incorporated both in the gelatin layer disposed between the support and the red-sensitive silver halide emulsion layer (Film (I)), the occurrence of latent image regression decreased. When the colored coupling compound was incorporated in the non-sensitive auxiliary layer alone (Film (J)), the reduction of sensitivity was not appreciably observed.

EXAMPLE 4

A coating liquid of Compound 5 was prepared by adding 100 ml of a 2% aqueous solution of the colored coupling compound of the present invention (Compound 5) and 50 ml of a 2% aqueous solution of 2-hydroxy-4,6-dichloro-s-triazine sodium salt as a hardening agent for gelatin, in this order, to 1,000 ml of a 5 wt% aqueous solution of gelatin.

A highly-sensitive red-sensitive photosensitive emulsion (VII) was prepared as follows: there were added, in succession, 130 ml of a 0.03% methanol solution of the optical sensitizer used in Example 1, 15 ml of a 1% aqueous solution of 5-methyl-7-hydroxy-1,3,4-triazaindolizine, 200 g of an emulsion of the colorless cyan coupler prepared in the manner given in Example 1, and 50 ml of a 2% aqueous solution of 2-hydroxy-4,6-dichloro-s-triazine sodium salt as a hardening agent for gelatin to 1,000 g of a highly-sensitive negative silver iodobromide emulsion containing 6.5 g of silver iodobromide (containing 6 mol% silver iodide per mole of silver and having an average grain size of 0.8μ) and 10 g of gelatin per 100 g of the emulsion.

A low sensitivity red-sensitive photosensitive emulsion (VIII) was prepared as follows: there were added, in succession, 220 ml of a 0.03% methanol solution of the optical sensitizer shown above, 30 ml of a 1% aqueous solution of 5-methyl-7-hydroxy-1,3,4-triazaindolizine, 400 g of an emulsion of the colorless cyan coupler prepared in the manner given in Example 1, and 50 ml of a 2% aqueous solution of 2-hydroxy-4,6-dichloro-s-triazine sodium salt as a hardening agent for gelatin to 1,000 g of a low sensitivity negative silver iodobromide emulsion containing 6.5 g of silver iodobromide (containing 8 mol% silver iodide per mole of silver and having an average grain size of 0.3μ) and 10 g of gelatin per 100 g of the emulsion.

Then, a color photographic film was prepared by coating on a cellulose triacetate support, in succession, the aforesaid gelatin solution containing the colored cyan coupler, the low sensitivity red-sensitive photosensitive emulsion (VIII), the highly-sensitive red-sensitive photosensitive emulsion layer (VII), the gelatin solution containing the colored cyan coupler and the green-sensitive photosensitive emulsion (II) prepared in the same manner as in Example 1. Both gelatin solutions containing the colored couplers were coated in a dry thickness of 2μ, respectively, and the low sensitivity red-sensitive photosensitive emulsion (I) prepared in the same manner as in Example 1, the highly-sensitive red-sensitive photo-sensitive emulsion (VII) and the green-sensitive photosensitive emulsion (II) were coated in a dry thickness of 2μ, 1μ and 3μ, respectively. The addition amounts of the colored cyan coupler in accordance with the present invention was controlled so as to provide an optical density of 0.3 in the gelatin layer between the support and the red-sensitive emulsion layer, 0.1 in the highly-sensitive red-sensitive emulsion layer and 0.1 in the gelatin layer between the red-sensitive emulsion layer and the green-sensitive emulsion layer, respectively.

Figure 2:
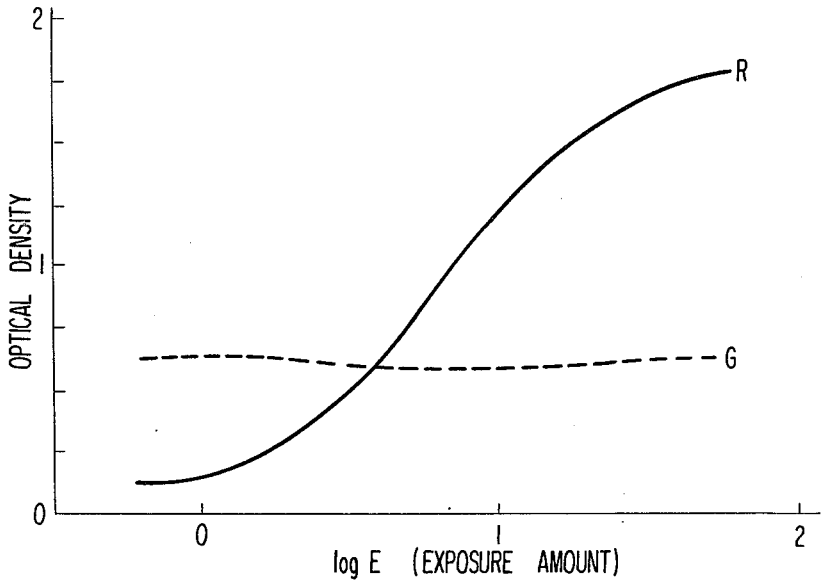
FIGS. 2 and 3 each are sensitometric characteristic curves after color development, in which curve R stands for the cyan dye image density and curve G stands for the magenta dye image density.
Figure 3:
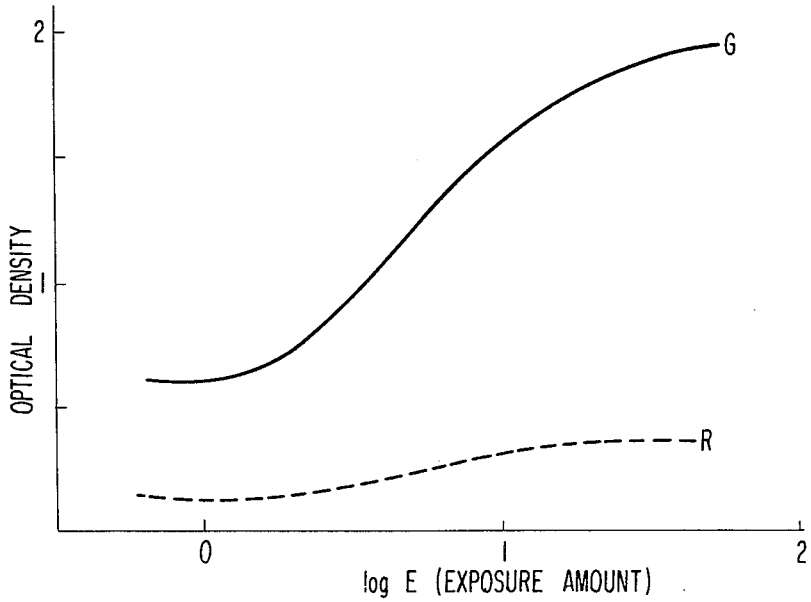

The film was exposed to red light and green light through an ordinary grey wedge. Thereafter, the film thus exposed was subjected to the color development process of Example 1. The densities of the film thus developed were measured with respect to red density and green density, and the results thereof are shown in FIG. 2 and FIG. 3, respectively. FIG. 2 is the sensitometric characteristic curve obtained by exposure to red light followed by the color development, in which curves R and G show the results obtained by the measurement of red and green densities, respectively. FIG. 3 is the sensitometric characteristic curve obtained by exposure to green light followed by the color development, in which curves R and G are the same as in FIG. 2.

As will be understood from the results shown in FIG. 2, it was noted that by the use of the colored coupling compound suitable for the layer structure in accordance with the present invention, the green side absorption component of the cyan dye image is effectively masked. It will also be noted from the results shown in FIG. 3 that there was no appreciable increase of the cyan density which could result in color mixing upon exposure to green light and therefore no problem was encountered from a practical viewpoint.

An identical sample of the film was exposed to red light through a grey wedge, preserved at room temperature for 2 weeks and then subjected to the color development; on the other hand, another sample of the film was stored at room temperature for 2 weeks, then exposed in a similar manner and subjected to the same color development. The sensitivities of these films were compared with the sensitivity in the case that the film was stored in a refregirator until immediately before exposure to light and color developed immediately after exposure to light. The decrease in sensitivity due to the storage of the films before and after exposure to light was −0.02 and −0.03, respectively (the density value is defined as the logarithm of the exposure amount which gives a density of fog plus 0.2), which was negligible decrease for practical use.

While the invention has been described in detail and with reference to specific embodiments thereof, it will be apparent to one skilled in the art that various changes and modifications can be made therein without departing from the spirit and scope thereof.

What is claimed is:

1. A multilayer color photographic material wherein green-red color mixing is effectively masked by a non-diffusible colored coupling compound which has a maximum absorption in the wavelength region of about 500 mμ to about 600 mμ, which is red before coupling and froms a cyan dye after coupling and provides a low decrease in sensitivity during storage of the photographic material, which photographic material comprises a support having coated thereon one or more red-sensitive silver halide emulsion layers containing a colorless cyan coupler, which, when two or more red-sensitive layers are used, differ in sensitivity, and a green-sensitive silver halide emulsion containing a colorless magenta coupler, said color photographic material having at least one layer having incorporated therein said non-diffusible colored coupling compound so that the optical density of a layer in which the colored coupling compound is present is about 0.05 to about 1.0, which releases upon coupling with the oxidation product of a primary aromatic amino color developing agent a duffusible dye capable of being removed from the photographic layer, said diffusible dye compensating for the green side absorption of the cyan dye, said layer being (1) a non-light-sensitive auxiliary layer disposed between the red-sensitive silver halide emulsion layer and the support; (2) a red-sensitive silver halide emulsion layer having higher relative sensitivity when two or more red-sensitive layers are used, or (3) a non-light-sensitive auxiliary layer disposed between the red-sensitive silver halide emulsion layer and the green-sensitive silver halide emulsion layer, wherein said non-diffusible colored coupling compound is a compound represented by the general formula $$[C] - L - [DD]$$

wherein [C] represents a non-diffusible cyan coupling compound group containing a phenol or α-naphthol nucleus, [DD] represents a diffusible azo, indoaniline or indophenol dye group, which possess a maximum absorption in the wavelength region of about 500 to about 600 mμ, —L— represents a coupling group between the non-diffusible coupling compound group [C] and the diffusible dye group [DD] selected from an imide bond, a carbonyloxy bond, a sulfinyl bond, a sulfonyl bond, an ether bond, an imino bond, a sulfonyloxy bond, a sulfoamido bond, an amido bond, a carbamoyloxy bond, or a thioether bond, and —L—[DD] represents a group which can be released from the compound when the compound undergoes oxidative coupling with said primary aromatic amino color developing agent and which can be removed from the photographic layer during said development, wherein said nondiffusible colored coupling compound is present in an amount of less than $5\times10^{-5}$ mol/m$^2$ when present in the red-sensitive silver halide emulsion layer (2) having higher relative sensitivity and is present in an amount of about $7\times10^{-5}$ to $20\times10^{-5}$ mol/m$^2$ when present in said non-light-sensitive auxiliary layer (1) disposed between the red-sensitive silver halide emulsion layer and the support or in said non-light-sensitive auxiliary layer (3) disposed between the red-sensitive silver halide emulsion layer and the green-sensitive silver halide emulsion layer.

2. The multilayer color photographic material as claimed in claim 1 wherein said color photographic material further comprises a yellow filter layer and a blue-sensitive silver halide emulsion layer.

3. The multilayer color photographic material as claimed in claim 1 wherein said colored coupling compound is incorporated in a non-light-sensitive auxiliary layer so that the optical density thereof is about 0.05 to about 1.0.

4. The multilayer color photographic material as claimed in claim 3, wherein the optical density is about 0.05 to 0.5.

5. The multilayer color photographic material as claimed in claim 1 wherein the ratio of said colored coupling compound to hydrophilic binder in the layer in which it is present is from about 1/1 to about 1/200.

6. The multilayer color photographic material as claimed in claim 1 wherein said non-diffusible colored coupling compound is incorporated in said non-light-sensitive auxiliary layer disposed between the red-sensitive silver halide emulsion layer and the support when the non-diffusible colored coupler is present in a single layer.

7. The multilayer color photographic material as claimed in claim 1, wherein said group —L—[DD] has general formula 2:

General Formula 2:

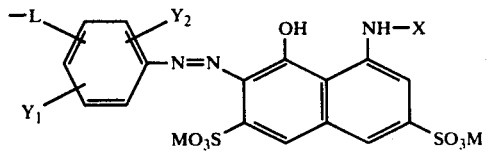

wherein L represents an oxygen atom, a sulfur atom, $—OCH_2CH_2O—$, $—OCH_2—$, $—OCH_2CH_2—$, $OCH_2CHOHCH_2O—$, $—O(CH_2)_3—O—$, $—O(CH_2)_4—O—$, $—OCH_2CH_2—O—CH_2CH_2O—$, $—NHSO_2—$, $—NHSO_2(CH_2)_3—O—$, $—NHSO_2(CH_2)_4—$, $—OSO_2(CH_2O—$, $—OSO_2(CH_2)_4—O—$, $—O—CO—NH—$, $—O—CO—$, $—O—COCH_2—$, or $—O—CO(CH_2)_n—O—$, wherein n is 0, 1, 2, 3, or 4, where these divalent groups are connected to the coupler constituting moiety at one side and to the dye moiety at their other side; X represents an acyl group having 1 to 8 carbon atoms or a sulfonyl group; $Y_1$ and $Y_2$ each represents a photographically inert group; and M represents a hydrogen atom or cation.

8. The multilayer color photographic material as claimed in claim 1, wherein said group —L—[DD] has general formula 3

General Formula 3:

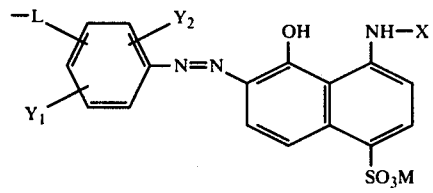

wherein L represents an oxygen atom, a sulfur atom, $—OCH_2CH_2O—$, $—OCH_2—$, $—OCH_2CH_2—$, $—OCH_2CHOHCH_2O—$, $—O(CH_2)_3—O—$, $—O(CH_2)_4—O—$, $—OCH_2CH_2—O—CH_2CH_2O—$, $—NHSO_2—$, $—NHSO_2(CH_2)_3—O—$, $—NHSO_2(CH_2)_4—$, $—OSO_2)(CH_2O—$, $—OSO_2(CH_2)_4—O—$, $—O—CO—NH—$, $—O—CO—$, $—O—COCH_2—$, or $—O—CO(CH_2)_n—O—$, wherein n is 0, 1, 2, 3, or 4, where these divalent groups are connected to the coupler constituting moiety at one side and to the dye moiety at their other side; X represents an acyl group having 1 to 8 carbon atoms or a sulfonyl group; $Y_1$ and $Y_2$ each represents a photographically inert group; and M represents a hydrogen atom or cation.

9. The multilayer color photographic material as claimed in claim 1, wherein said group —L—[DD] has a general formula 4:

General Formula 4:

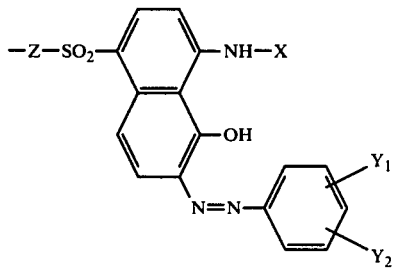

wherein X represents an acyl group having 1 to 8 carbon atoms or a sulfonyl group, $Y_1$ and $Y_2$ each represents a photographically inert group and Z represents an oxygen atom or —NH—.

10. The multilayer color photographic material as claimed in claim 1, wherein said color coupling compound is selected from compounds below:

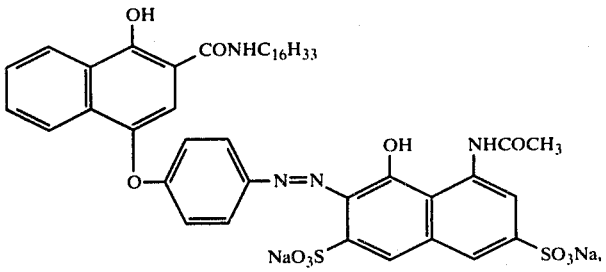
OH
CONHC16H33
OH
NHCOCH3
O
N=N
NaO3S
SO3Na,
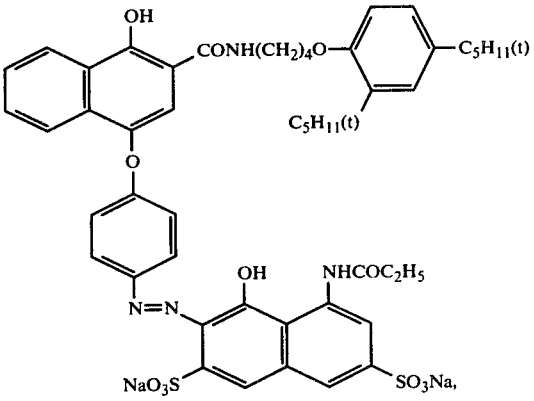
OH
CONH(CH2)4O
C5H11(t)
C5H11(t)
O
OH
NHCOC2H5
N=N
NaO3S
SO3Na,
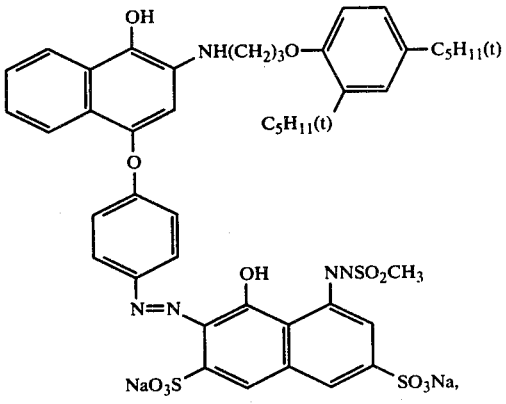
OH
NH(CH2)3O
C5H11(t)
C5H11(t)
O
OH
NNSO2CH3
N=N
NaO3S
SO3Na,
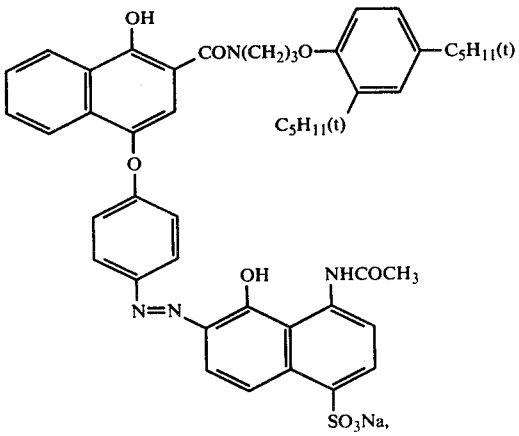
OH
CON(CH2)3O
C5H11(t)
C5H11(t)
O
OH
NHCOCH3
N=N
SO3Na, -continued
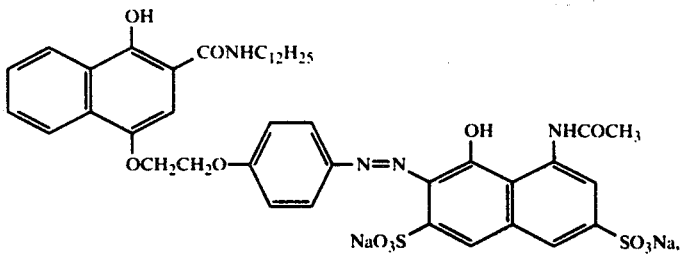
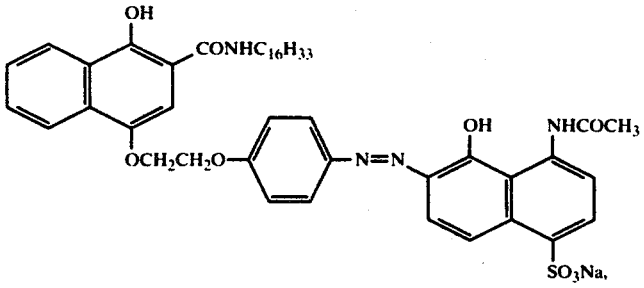
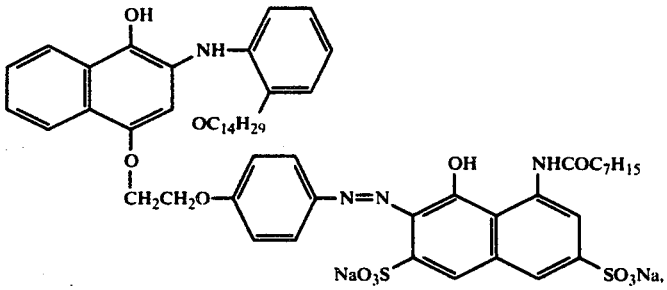
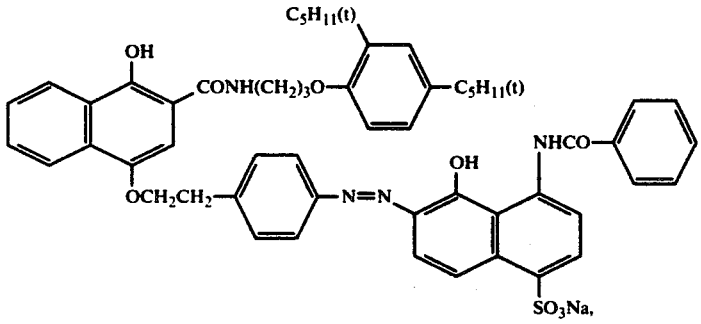
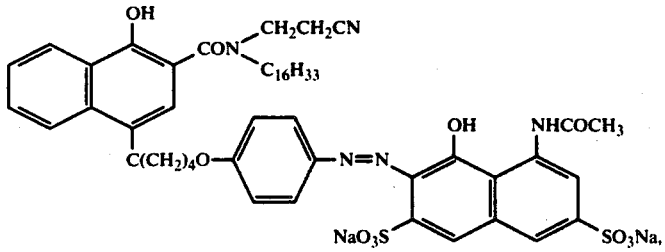
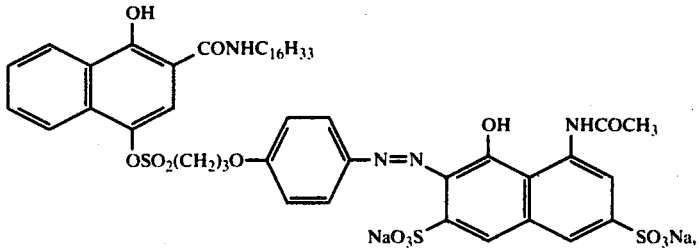

-continued
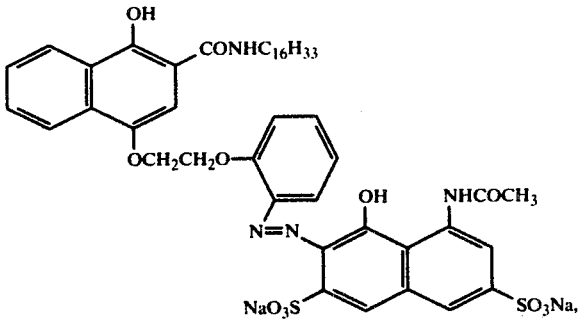
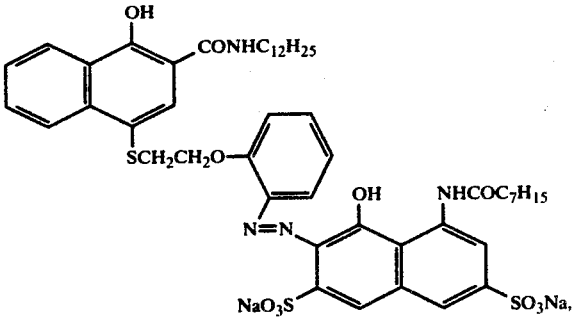
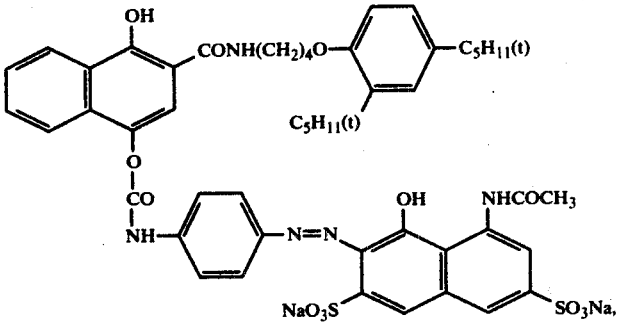
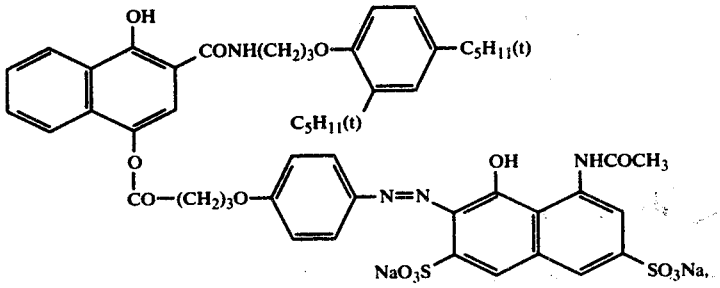
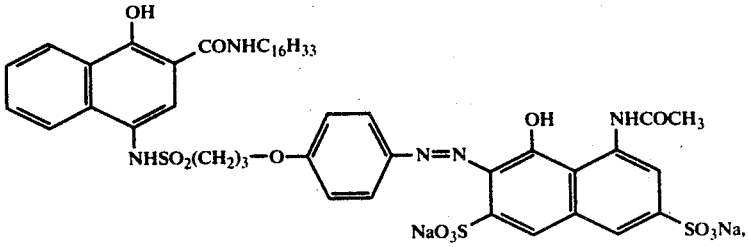

-continued
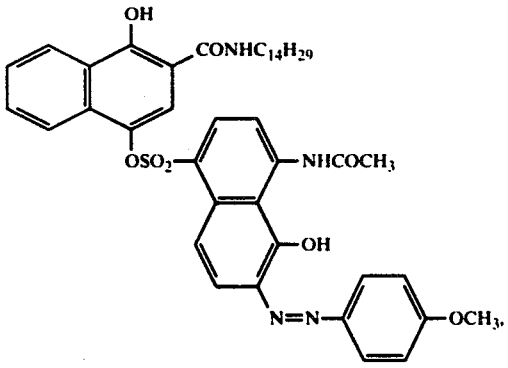
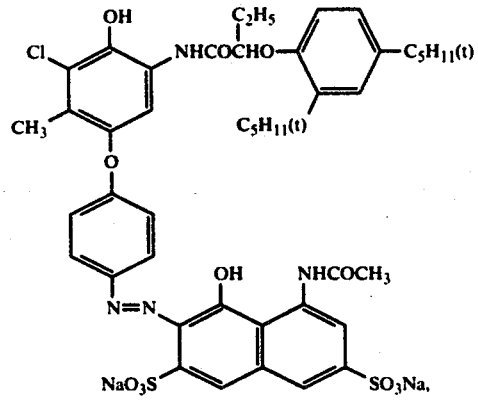
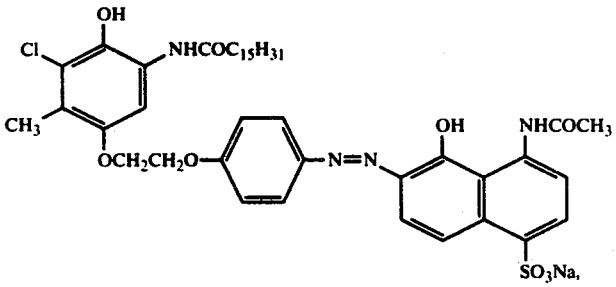
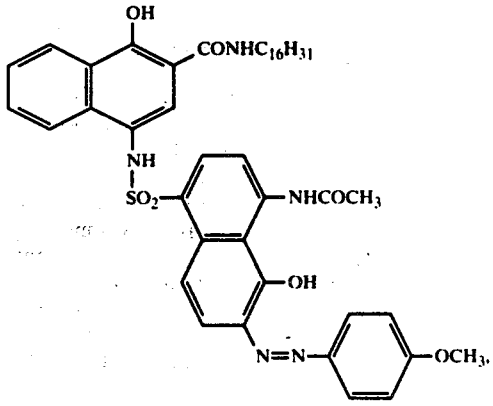

-continued

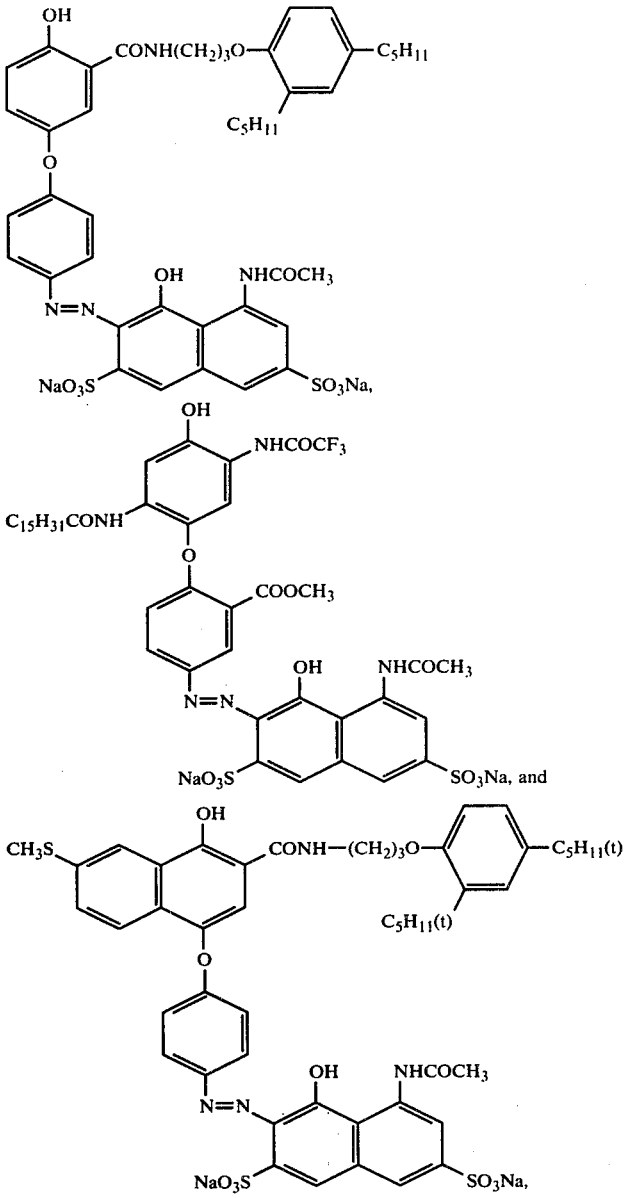

11. The multilayer color photographic material as claimed in claim 1, wherein said multilayer color photographic material is a negative multilayer color photographic material comprising the following photographic layers: a support having coated thereon, in succession, a non-sensitive auxiliary layer, at least one red-sensitive silver halide emulsion layer, an optional non-sensitive auxiliary layer, a green-sensitive halide emulsion layer, an optional yellow filter layer, a blue-sensitive silver halide emulsion layer, and an optional uppermost protective layer.

12. The multilayer color photographic material as claimed in claim 1, wherein two or more red-sensitive layers are used and said non-diffusible colored coupling compound is present in said emulsion layer having higher relative sensitivity.

13. The multilayer color photographic material as claimed in claim 1, wherein said non-diffusible colored coupling compound is present in said non-light-sensitive auxiliary layer disposed between the red-sensitive silver halide emulsion and the support.

14. The multilayer color photographic material as claimed in claim 1, wherein said non-diffusible colored coupling compound is the only compound present which exerts a masking effect.

15. A method of effectively masking green-red color mixing in a multi color photographic material by a non-diffusible colored coupling compound which has a maximum absorption in the wavelength region of about 500 mμ to about 600 mμ, which is red before coupling and forms a cyan dye after coupling and provides a low decrease in sensitivity during storage of the photographic material, which is exposed and developed, said photographic material comprising a support having coated thereon one or more red-sensitive silver halide emulsion layers containing a colorless cyan coupler, which, when two or more red-sensitive layers are used, differ in sensitivity, and a green-sensitive silver halide emulsion layer containing a colorless magenta coupler, which method comprises coating on said support at least one layer having incorporated therein said non-diffusible colored coupling compound so that the optical density of the layer in which the colored coupling compound is present is about 0.05 to about 1.0, which releases upon coupling, during development, with the oxidation product of a primary aromatic amino color developing agent a diffusible dye which is removed from the photographic layer, said diffusible dye compensating for the green side absorption of the cyan dye, said layer being (1) a non-light-sensitive auxiliary layer disposed between the red-sensitive silver halide emulsion layer and the support; (2) a red-sensitive silver halide emulsion layer having higher relative sensitivity when two or more red-sensitive layers are used, or (3) a non-light-sensitive auxiliary layer disposed between the red-sensitive silver halide emulsion layer and the green-sensitive silver halide emulsion layer, wherein said non-diffusible colored coupling compound is a compound represented by the general formula

[C] — L — [DD]

wherein [C] represents a non-diffusible cyan coupling compound group containing a phenol or α-naphthol nucleus, [DD] represents a diffusible azo, indoaniline or indophenol dye group which possess a maximum absorption in the wavelength of about 500 to about 600 mμ, —L— represents a coupling group between the non-diffusible coupling compound group [C] and the diffusible dye group [DD] selected from an immide bond, a carbonyloxy bond, a sulfinyl bond, a sulfonyl bond, an ether bond, an imino bond, a sulfonyloxy bond, a sulfoamido bond, an amido bond, a carbamoyloxy bond, or a thioether bond, and —L—[DD] represents a group which can be released from the compound when the compound undergoes oxidative coupling with said primary aromatic amino color developing agent and which can be removed from the photographic layer during said development, wherein said non-diffusible colored coupling compound is present in an amount of less than $5\times10^{-5}$ mol/m$^2$ when present in the red-sensitive silver halide emulsion layer having higher relative sensitivity and is present in an amount of about $7\times10^{-5}$ to $20\times10^{-5}$ mol/m$^2$ when present in said non-light-sensitive auxiliary layer disposed between the red-sensitive silver halide emulsion layer and the support or in said non-light-sensitive auxiliary layer disposed between the red-sensitive silver halide emulsion layer and the green-sensitive silver halide emulsion layer, and thereafter image-wise exposing and developing in the pressence of said primary aromatic amino color developing agent.

16. The method of claim 15, wherein said non-diffusible colored coupling compound is present in said non-light sensitive auxiliary layer disposed between the red-sensitive silver halide emulsion layer and the support.

17. The method of claim 15, wherein two or more red-sensitive layers are used, and wherein said non-diffusible colored coupling compound is present in said red-sensitive silver halide emulsion layer having higher relative sensitivity.

18. The method of claim 15, wherein said non-diffusible colored coupling compound is present in said non-light-sensitive auxiliary layer disposed between the red-sensitive silver halide emulsion layer and the green-sensitive silver halide emulsion layer.

19. The method of claim 15, wherein said non-diffusible colored coupling compound is the only compound present which exerts a masking effect.

20. The method as claimed in claim 15, wherein said color photographic material further comprises a yellow filter layer and a blue-sensitive silver halide emulsion layer.

* * * * *